US009379449B2

(12) United States Patent
Cetiner et al.

(10) Patent No.: US 9,379,449 B2
(45) Date of Patent: Jun. 28, 2016

(54) RECONFIGURABLE ANTENNAS UTILIZING PARASITIC PIXEL LAYERS

(71) Applicant: Utah State University, North Logan, UT (US)

(72) Inventors: Bedri Cetiner, Logan, UT (US); Daniel Rodrigo, Montcada (ES); Luis Jofre, Barcelona (ES)

(73) Assignee: Utah State University, North Logan, UT (US)

( * ) Notice: Subject to any disclaimer, the term of this patent is extended or adjusted under 35 U.S.C. 154(b) by 422 days.

(21) Appl. No.: 13/654,209

(22) Filed: Oct. 17, 2012

(65) Prior Publication Data

US 2013/0176177 A1 Jul. 11, 2013

Related U.S. Application Data

(60) Provisional application No. 61/584,546, filed on Jan. 9, 2012.

(51) Int. Cl.

| | |
|---|---|
| ***H01Q 19/00*** | (2006.01) |
| ***H01Q 3/01*** | (2006.01) |
| ***H01Q 9/04*** | (2006.01) |

(52) U.S. Cl.

CPC ..... *H01Q 19/005* (2013.01); *H01Q 3/01* (2013.01); *H01Q 9/0414* (2013.01); *H01Q 9/0442* (2013.01)

(58) Field of Classification Search

CPC ..... H01Q 19/005; H01Q 9/0414; H01Q 3/01; H01Q 9/0442; H01Q 15/002

See application file for complete search history.

(56) References Cited

U.S. PATENT DOCUMENTS

| | | | | |
|---|---|---|---|---|
| 3,560,978 | A | 2/1971 | Himmel et al. | |
| 4,700,197 | A | 10/1987 | Milne | |
| 4,847,625 | A * | 7/1989 | Dietrich et al. | 343/700 MS |
| 5,235,343 | A | 8/1993 | Audren et al. | |
| 5,767,807 | A | 6/1998 | Pritchett | |

(Continued)

FOREIGN PATENT DOCUMENTS

| | | | |
|---|---|---|---|
| JP | 06350334 | A | 12/1994 |
| JP | 11097926 | A | 4/1999 |

(Continued)

OTHER PUBLICATIONS

Demestichas, P. et al., A European Perspective on Composite Reconfigurable Radio Networks. Wireless Communications, IEEE, 13(3), 6-7, Jun. 2006.

(Continued)

*Primary Examiner* — Hoang V Nguyen
*Assistant Examiner* — Daniel J Munoz

(57) ABSTRACT

Reconfigurable antennas utilizing parasitic layers are disclosed herein. In certain embodiments, a reconfigurable antenna may include an active driven antenna element. The active driven antenna may be a patch antenna element. A parasitic element may be disposed over the active antenna element and be configured to couple with electromagnetic energy emitted from the active antenna element via electromagnetic mutual coupling. The parasitic element may include an array of selectively reconfigurable pixels interconnected via microelectromechanical switches. By selectively reconfiguring the geometry of the array, the reconfigurable antenna may be configured to operate in multiple operating modes.

22 Claims, 17 Drawing Sheets

(56) References Cited

U.S. PATENT DOCUMENTS

| | | | | |
|---|---|---|---|---|
| 6,037,905 | A | 3/2000 | Koscica et al. | |
| 6,175,723 | B1 | 1/2001 | Rothwell | |
| 6,181,970 | B1 | 1/2001 | Kasevich | |
| 6,198,438 | B1 * | 3/2001 | Herd et al. | 343/700 MS |
| 6,404,401 | B2 | 6/2002 | Gilbert et al. | |
| 6,407,719 | B1 | 6/2002 | Ohira et al. | |
| 6,473,362 | B1 | 10/2002 | Gabbay | |
| 6,483,480 | B1 | 11/2002 | Sievenpiper et al. | |
| 6,496,155 | B1 | 12/2002 | Sievenpiper et al. | |
| 6,501,427 | B1 | 12/2002 | Lilly et al. | |
| 6,515,635 | B2 | 2/2003 | Chiang et al. | |
| 6,859,189 | B1 | 2/2005 | Ramirez et al. | |
| 8,354,972 | B2 | 1/2013 | Borja et al. | |
| 2004/0080456 | A1 * | 4/2004 | Tran | 343/700 MS |
| 2004/0095288 | A1 | 5/2004 | Jackson | |
| 2004/0227583 | A1 | 11/2004 | Shaffner et al. | |
| 2004/0227667 | A1 * | 11/2004 | Sievenpiper | 343/700 MS |
| 2004/0252069 | A1 | 12/2004 | Rawnick et al. | |
| 2005/0012675 | A1 * | 1/2005 | Sakiyama et al. | 343/824 |
| 2005/0048934 | A1 * | 3/2005 | Rawnick et al. | 455/107 |
| 2005/0078047 | A1 | 4/2005 | Chiang et al. | |
| 2005/0088358 | A1 | 4/2005 | Larry et al. | |
| 2005/0190106 | A1 | 9/2005 | Pros et al. | |
| 2007/0046543 | A1 | 3/2007 | Choi et al. | |
| 2007/0200767 | A1 | 8/2007 | Yoshioka et al. | |
| 2007/0229357 | A1 | 10/2007 | Zhang et al. | |
| 2007/0279286 | A1 | 12/2007 | Coutts et al. | |
| 2008/0088510 | A1 | 4/2008 | Murata et al. | |
| 2008/0136597 | A1 | 6/2008 | Choi et al. | |
| 2009/0322646 | A1 | 12/2009 | Dreina et al. | |
| 2010/0095762 | A1 | 4/2010 | Despesse | |
| 2010/0117913 | A1 | 5/2010 | Jung | |
| 2010/0171675 | A1 | 7/2010 | Borja et al. | |
| 2010/0176999 | A1 | 7/2010 | Anguera et al. | |
| 2010/0238072 | A1 | 9/2010 | Ayatollahi et al. | |
| 2011/0095960 | A1 | 4/2011 | Shtrom et al. | |
| 2011/0109524 | A1 | 5/2011 | Säily | |
| 2011/0298684 | A1 | 12/2011 | Quan et al. | |
| 2012/0007778 | A1 | 1/2012 | Duwel et al. | |

FOREIGN PATENT DOCUMENTS

| | | | |
|---|---|---|---|
| KR | 20080053081 | A | 6/2008 |
| WO | 2010029306 | A1 | 3/2010 |

OTHER PUBLICATIONS

Alexiou A. and Haardt, M., Smart Antenna Technologies for Future Wireless Systems: Trends and Challenges. Communications Magazine, IEEE, 42(9), 90-97, Sep. 2004.

Akyildiz, I. et al., NeXt generation/ dynamic spectrum access/cognitive radio wireless networks: A survey. Computer Networks, 50(13), 2127-2159, May 2006.

Migliore, M. D., et al., A Simple and Robust Adaptive Parasitic Antenna. IEEE Transactions on Antennas & Propagation, 53(10), 3262-3272. Oct. 2005.

Mehmood, R. and Wallace, J., Interference Suppression Using Parasitic Reconfigurable Aperture (recap) Antennas. in Proc. Int Antenna Technology (iWAT) Workshop, 82-85, 2011.

Cetiner B., et al., Multifunctional Reconfigurable MEMS Integrated Antennas for Adaptive MIMO Systems. IEEE Communications Magazine, 42(12), 62-70, Dec. 2004.

Eslami H., et al., Reduced Overhead Training for Multi Reconfigurable Antennas with Beam-Tilting Capability. IEEE Transactions on Wireless Communications, 9(12), 3810-3821, Dec. 2010.

Bernhard, J., Reconfigurable Antennas. Ser. Synthesis Lectures on Antennas. Morgan & Claypool Publishers, 2007.

Huff, G. H. and Bernhard, J. "Reconfigurable Antennas," in Modern Antenna handbook. C. A. Balanis, Ed. John Wiley & Sons, Inc., 369-398, 2008.

Bernhard, J.T., Reconfigurable Multifunction Antennas: Next steps for the Future. n Proc. Int Microwave, Antenna, Propagation and EMC Technologies for Wireless Communications Symp, 2007.

Yang, X.S., et al., Yagi Patch Antenna With Dual-Band and Pattern Reconfigurable Characteristics. IEEE Antennas Wireless Propagation Letter, 6, 168-171, 2007.

Panagamuwa, C. J., et al., Frequency and Beam Reconfigurable Antenna Using Photoconducting Switches. IEEE Transactions on Antennas & Propagation, 54(2), 449-454, Feb. 2006.

Nikolaou, S., et al., Pattern and Frequency Reconfigurable Annular Slot Antenna Using PIN Diodes. IEEE Transactions on Antennas & Propagation, 54(2), 439-448, Feb. 2006.

Huff, G. H., et al., A Novel Radiation Pattern and Frequency Reconfigurable Single Turn Square Spiral Microstrip Antenna. EEE Microwave and Wireless Components Letters, 13(2), 57-59, Feb. 2003.

Row, J. S. and Shih, C. J., Polarization-Diversity Ring Slot Antenna With Frequency Agility. IEEE Transactions on Antennas & Propagation, 60(8), 3953-3957, Aug. 2012.

Cao, W., et al., A Reconfigurable Microstrip Antenna With Radiation Pattern Selectivity and Polarization Diversity. IEEE Antennas and Wireless Propagation Letter, 11, 453-456, 2012.

Pringle, L., et al., A Reconfigurable Aperture Antenna Based on Switched Links Between Electrically Small Metallic Patches, IEEE Transactions on Antennas & Propagation, 52(6), 1434-1445, Jun. 2004.

Besoli, A. G. and Flaviis, F. D., A Multifunctional Reconfigurable Pixeled Antenna Using MEMS Technology on Printed Circuit Board. IEEE Transactions on Antennas & Propagation, 59(12), 4413-4424, Dec. 2011.

Rodrigo, D. and Jofre, L., Frequency and Radiation Pattern Reconfigurability of a Multi-Size Pixel Antenna, IEEE Trans. Antennas Propag., vol. 60, No. 5, pp. 2219-2225, May 2012.

Rodrigo, D., et al., Antenna Reconfigurability based on a Novel Parasitic Pixel Layer. Proceedings of the 5th European Conference on Antennas and Propagation (EUCAP), 3497-3500, 2011.

Li, Z., et al., Beam-steering antenna based on parasitic layer. Electronics Letters, 48(2), 59-60, Jan. 2012.

Yuan, X., et al., A Parasitic Layer-Based Reconfigurable Antenna Design by Multi-Objective Optimization. IEEE Transactions on Antennas & Propagation, 60(6), 2690-2701, Jun. 2012.

Weily, A., et al., A Reconfigurable High-Gain Partially Reflecting Surface Antenna. IEEE Transactions on Antennas & Propagation, 56(11), 3382-3390, Nov. 2008.

Debogovic, T., et al., Partially Reflective Surface Antenna With Dynamic Beamwidth Control. IEEE Antennas and Wireless Propagation Letter, 9, 1157-1160, 2010.

Bap64-02 silicon PIN diode, NXP semiconductors. rev. 06, 2008.

Wheeler, H., The Radiansphere Around a Small Antenna, Proceedings of the IRE, 47(8), 1325-1331, 1959.

Croq, F. and Pozar, D., Millimeter-Wave Design of Wide-Band Aperture-Coupled Stacked Microstrip Antennas. IEEE Transactions on Antennas & Propagation, 39(12), 1770-1776, Dec. 1991.

IEEE standard definitions of terms for antennas. IEEE Std 145-1983, 1993.

Donelli, M., et al., A Planar Electronically Reconfigurable Wi-Fi Band Antenna Based on a Parasitic Microstrip Structure, IEEE Antennas and Wireless Propagation Letters, vol. 6, 623-626, 2007.

Vaughan, R., Switched Parasitic Elements for Antenna Diversity, IEEE Transactions on Antennas and Propagation, vol. 47 (2) 399-405, Feb. 1999.

Daheshpour, K., et al., Pattern reconfigurable antenna based on moving V-shaped parasitic elements actuated by dielectric elastomer, Electronics Letters, vol. 46 (13) 886-888, Jun. 2010.

Cetiner, B.A. et al., "A New Class of Antenna Array with a Reconfigurable Element Factor," IEEE Transactions on Antennas and Propagation, Dec. 13, 2013.

Notification of Transmittal of the International Search Report and the Written Opinion of the International Searching Authority, or the Declaration, dated Jul. 25, 2013, for PCT/US2012/059378, filed Oct. 9, 2012.

Ju-Hee et al., Reversibly Deformable and Mechanically Tunable Fluidic Antennas, Advanced Functional Materials, Nov. 23, 2009, pp. 3632-3637, vol. 19, Issue 22, Wiley-VCH Verlag GmbH & Co.

(56) References Cited

OTHER PUBLICATIONS

Notification of Transmittal of the International Search Report and the Written Opinion of the International Searching Authority, or the Declaration, dated Aug. 26, 2013, for PCT/US2012/068386, filed Dec. 7, 2012.

Cetiner et al., A Parasitic Layer-Based Reconfigurable Antenna Design by Multi-Objective Optimization, IEEE Transactions on Antennas and Propagation, vol. 60, No. 6, Jun. 2012.

Donelli et al., A Planar Electronically Reconfigurable Wi-Fi Band Antenna Based on a Parasitic Microstrip Structure, IEEE Antennas and Wireless Propagation Letters, vol. 6, 2007.

Migliore, A Simple and Robust Adaptive Parasitic Antenna, IEEE Transactions on Antennas and Propagation, vol. 53, No. 10, Oct. 2005.

Cetiner et al., Antenna Reconfigurability based on a Novel Parasitic Pixel Layer, Proc. 5th European Conf. Antennas and Propagation (EUCAP), 2011, pp. 3497-3500.

Cetiner et al., Beam-steering antenna based on parasitic layer, Electronics Letters, Jan. 19, 2012, vol. 48 No. 2.

Rodrigo et al., Frequency and Radiation Pattern Reconfigurability of a Multi-Size Pixel Antenna, IEEE Transactions on Antennas and Propagation, May 2012, vol. 60, No. 5.

Daheshpour et al., Pattern reconfigurable antenna based on moving V-shaped parasitic elements actuated by dielectric elastomer, Electronics Letters, Jun. 24, 2010, vol. 46, No. 13.

Vaughan, Switched Parasitic Elements for Antenna Diversity, IEEE Transactions on Antennas and Propagation, Feb. 1999, vol. 47, No. 2.

Cetiner et al., Compact and Broadband Antenna for LTE and Public Safety Applications, IEEE Antennas and Wireless Propagation Letters, Oct. 28, 2011, vol. 10, pp. 12224-1227.

Khoshniat et al., MEMS Integrated Reconfigurable Antenna for Cognitive Public Safety Radios, Proceedings of the Fourth European Conference on Antennas and Propagation (EuCAP), Barcelona, Spain, Apr. 12-16, 2010, pp. 1-3.

Jofre et al., Miniature Multi-element Antenna for Wireless Communications, IEEE Transactions on Antennas and Propagation, May 2002, vol. 50, Issue 5, pp. 658-669.

Notification of Transmittal of the International Search Report and the Written Opinion of the International Searching Authority, or the Declaration, dated Aug. 27, 2013, for PCT/US2012/064616, filed Nov. 12, 2012.

* cited by examiner

Chromosome Structure 0 1 0 0 | 1 1 0 1 | 1 0 1 1 | 0 1 1 1 | 1 1 1 1 | 1 0 1 1 0 | 1 0 0 1 0 | 1 0 1 1 1 | 1 1 0 0 0

Beam Steering Modes in the x-z Plane With Linear Polarization

Beam Steering Modes in the x-z Plane With Circular Polarization

Beam Steering Modes in the y-z Plane With Linear Polarization

RECONFIGURABLE ANTENNAS UTILIZING PARASITIC PIXEL LAYERS

RELATED APPLICATIONS

This application claims priority under 35 U.S.C. §119(e) to U.S. Provisional Patent Application No. 61/584,546, filed Jan. 9, 2012, and entitled "RECONFIGURABLE ANTENNAS UTILIZING A PARASITIC LAYER," which is incorporated herein by reference in its entirety.

STATEMENT REGARDING FEDERALLY SPONSORED RESEARCH

The technology described in this application was developed at least in part by Award No. 2007-IJCX-K025 and Award No. 2009-SQ-B9-K005, awarded by the National Institute of Justice, Office of Justice Programs, United States Department of Justice. The U.S. government has certain rights in the invention.

TECHNICAL FIELD

This disclosure relates generally to reconfigurable antennas. More specifically, but not exclusively, this disclosure relates to reconfigurable antenna designs utilizing parasitic layers.

SUMMARY

The present disclosure in aspects and embodiments describes a reconfigurable antenna that includes an active driven antenna element and a parasitic element disposed over the active antenna element, the parasitic element including an array of selectively reconfigurable pixels. In embodiments, a geometry of the array is reconfigurable; the parasitic element may further include a network of microelectromechanical switches configured to selectively reconfigure the array of selectively reconfigurable pixels based on control voltages.

The reconfigurable antenna may be configured to operate at frequencies between 4 GHz and 6 GHz. In embodiments, the reconfigurable antenna further includes highly resistive bias lines configured to drive one or more microelectromechanical switches of the network of microelectromechanical switches by the control voltages.

In embodiments, the array of selectively reconfigurable pixels may be arranged in a grid pattern. The reconfigurable antenna may be configured to operate in a plurality of operating modes, each operating mode corresponding to a particular configuration of the array of selectively reconfigurable pixels.

The reconfigurable antenna may be configured to operate at a plurality of beam steering angles based at least in part on the configuration of the array of selectively reconfigurable pixels. In embodiments, the plurality of beam steering angles include at least one of beam steering angle between $\theta_i$=−60° and 60°. The reconfigurable antenna may be configured to operate at a Linear, Circular, or Elliptical polarization based at least in part on the array of selectively reconfigurable pixels.

The reconfigurable antenna may include a plurality of antenna array elements, each antenna array element including at least one of the active driven antenna element and the parasitic element.

The disclosure further describes a reconfigurable antenna that includes a plurality of antenna array elements, each antenna array element containing an active driven antenna element and a parasitic element disposed over the active antenna element, the parasitic element comprising an array of selectively reconfigurable pixels configured to couple with electromagnetic energy emitted from the active antenna element via electromagnetic mutual coupling.

In embodiments, the antenna array elements are arranged in a linear array configuration; the reconfigurable antenna may be configured to operate at frequencies between 4 GHz and 6 GHz.

The reconfigurable antenna may further include an aperture coupled feed line configured to feed the active driven antenna element and the array of selectively reconfigurable pixels may be arranged in a grid pattern and a foam substrate may be configured to separate the parasitic element from the active driven antenna element.

In embodiments, the reconfigurable antenna may be configured to operate at a plurality of beam steering angles based at least in part on the configuration of the array of selectively reconfigurable pixels. The plurality of beam steering angles may include at least one of beam steering angle between $\theta_i$=−60° and 60°.

In other embodiments, the reconfigurable antenna may be configured to operate at a Linear, Circular, or Elliptical polarization based at least in part on the configuration of the parasitic element.

The present disclosure also describes a method for determining a configuration for reconfigurable antenna having one or more desired operational modes using a combinatorial optimization performed by a computer system including a processor and a non-transitory computer-readable medium storing instructions that, when executed by the processor, cause the processor to store a representation of a chromosome structure of a parasitic pixel surface of the reconfigurable antenna; determine one or more objective functions for the one or more desired operational modes; define one or more optimization problems based on the representation and the one or more objective functions; determine one or more iterative solutions to the one or more optimization problems; and determine a configuration for the parasitic pixel surface based on a terminal solution of the one or more iterative solutions.

BRIEF DESCRIPTION OF THE DRAWINGS

Non-limiting and non-exhausting embodiments of the disclosure are described, including various embodiments of the disclosure with reference to the figures, in which.

DETAILED DESCRIPTION

Figure 1:
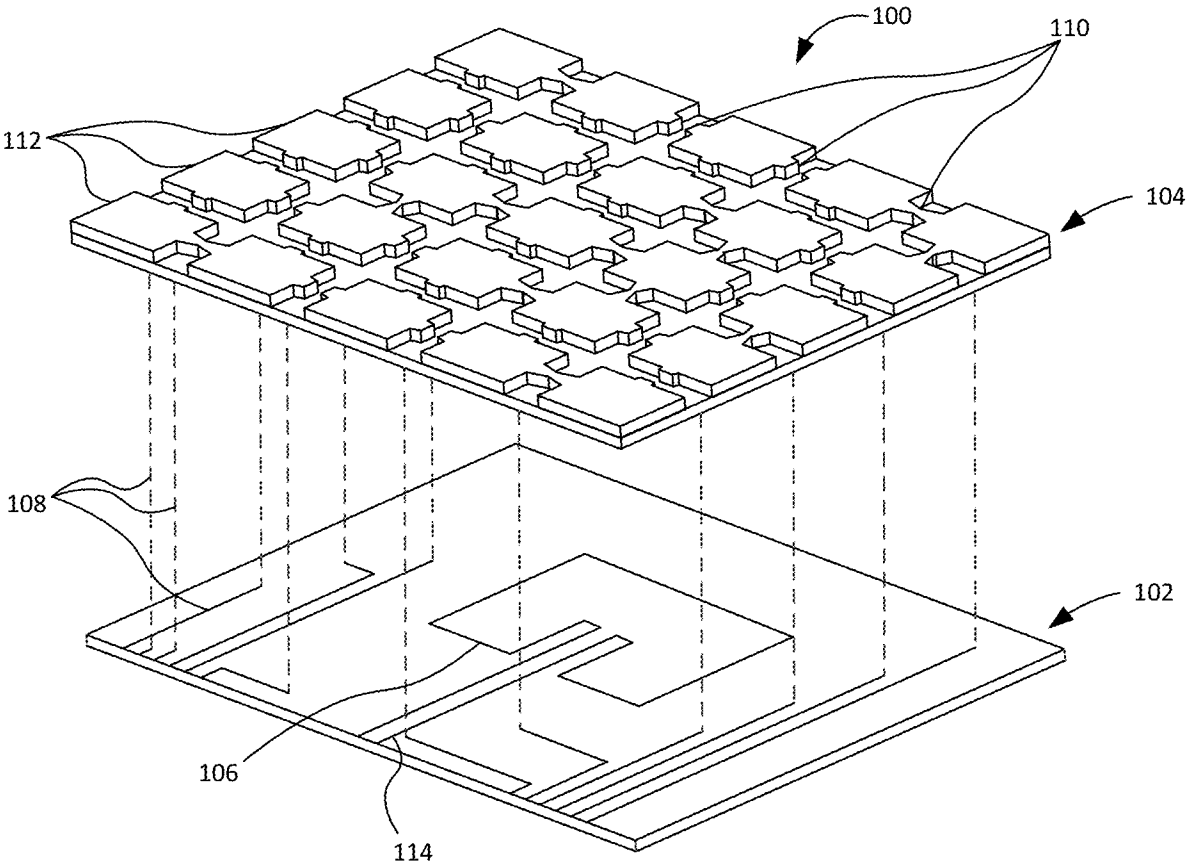
FIG. 1 illustrates an exploded view of a reconfigurable antenna.

The embodiments of the disclosure may be understood by reference to the drawings. It will be readily understood that the components of the disclosed embodiments, as generally described and illustrated in the figures herein, could be arranged and designed in a wide variety of different configurations. Thus, the following detailed description of the embodiments of the systems and methods of the disclosure is not intended to limit the scope of the disclosure, as claimed, but is merely representative of possible embodiments of the disclosure. In addition, the steps of a method do not necessarily need to be executed in any specific order, or even sequentially, nor do the steps need be executed only once, unless otherwise specified.

In some cases, well-known features, structures, or operations are not shown or described in detail. Furthermore, the described features, structures, or operations may be combined in any suitable manner in one or more embodiments. It will also be readily understood that the components of the embodiments, as generally described and illustrated in the figures herein, could be arranged and designed in a wide variety of different configurations. For example, throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

In this specification and the claims that follow, singular forms such as "a," "an," and "the" include plural forms unless the content clearly dictates otherwise. All ranges disclosed herein include, unless specifically indicated, all endpoints and intermediate values. In addition, "optional," "optionally" or "or" refer, for example, to instances in which subsequently described circumstance may or may not occur, and include instances in which the circumstance occurs and instances in which the circumstance does not occur. The terms "one or more" and "at least one" refer, for example, to instances in which one of the subsequently described circumstances occurs, and to instances in which more than one of the subsequently described circumstances occurs.

The proliferation of wireless devices has made the development of antennas capable of exhibiting variable radiation patterns desirable. Reconfigurable antennas capable of varying operating frequency, bandwidth, radiation pattern, or polarization offer certain advantages over non-reconfigurable antennas due to their capability of providing dynamic adaptation to changes in a communications channel or in system requirements. Utilizing a reconfigurable antenna may allow for a reduction in the overall size of multi-mode, multi-band, wireless communication systems. A reconfigurable antenna may also allow for more degrees of freedom of adaptive system parameters that may provide capacity gains. In certain embodiments, these capacity gains may result in part from optimizing the reconfigurable antenna with adaptive space-time modulation techniques in response to changes in the propagation environment.

Multi-functional reconfigurable antennas (MRAs) that include a reconfigurable parasitic pixel layer to achieve dynamic antenna performance are disclosed. In certain embodiments, an MRA may be designed utilizing a multi-objective genetic optimization algorithm. Certain MRAs disclosed herein may be capable of steering their radiation pattern into at least three different directions (e.g., $\theta_i$=−60°, 0°, 60°) and reconfiguring their polarization (e.g., $P_j$=Linear, Circular, Elliptical), although antennas with other modes of operation are also presented. For example, certain MRAs consistent with embodiments disclosed herein may be capable of steering their radiation pattern across a dynamic range of directions (e.g., $\theta_i$ between −60° and 60°) and reconfiguring their polarization to any suitable polarization (e.g., right hand circular polarization, left hand circular polarization, or the like).

In some embodiments, an MRA may include a driven microstrip-fed patch element and a reconfigurable parasitic layer disposed on top of the patch element. An MRA may include an aperture-coupled patch element and a reconfigurable layer disposed above the patch element. The reconfigurable parasitic layer may include a grid of electrically conductive pixels. The grid may be configured into any suitable shape, such as a linear shape, square, rectangular, polygon, triangle, octagon, hexagon, pentagon, or other suitably shaped grid configuration). Other suitable shaped grids may include, L-shapes, T-shapes, crosses, stars, and other suitable shapes. For example, an N×M grid may be utilized where N and M may independently represent any integer, such as 1, 2, 3, 4, 5, 6, 7, 8, 9, 10, 11, 12, 13, 14, 15, 16, 17, 18, 19, 20, or more. The total number of pixels may vary depending on the application, for example, the number of pixels may be from 2 to 1000, such as from 10 to 500, from 20 to 200, or from 30 to 100. The electrically conductive pixels may be small metallic pixels or may be of any suitable pixel shape, such as rectangular pixels, triangular pixels, hexagonal pixels, circular pixels, oval-shaped pixels, any other suitable pixel shape, and any combination thereof).

The reconfigurable parasitic pixel surface may be configured to couple electromagnetic energy emitted from the driven patch element through mutual coupling or any other suitable electromagnetic effect. Adjacent pixels of the reconfigurable parasitic pixel surface may be connected and disconnected by means of switching, thereby allowing the geometry of the pixel surface to change. By changing the geometry of the parasitic pixel surface, the current distribution over the parasitic layer may also change to exhibit a desired mode of operation in terms of beam direction and polarization. In certain embodiments, a reconfigurable antenna consistent with embodiments disclosed herein may operate according to one or more wireless standards. For example, an MRA may be configured to operate according to the IEEE 802.11 WLAN standards (e.g., in the 5-6 GHz frequency range. In further embodiments a reconfigurable antenna may be configured to operate in any suitable frequency range (e.g., from 0.1 GHz to $10^{12}$ Hz and any frequency in between). In all modes of operation, a reconfigurable antenna may exhibit approximately 8 dB gain, although other gain levels are also possible consistent with the embodiments disclosed herein.

In certain embodiments, properties of the disclosed antennas may be reconfigured by coupling the electromagnetic energy from the driven antenna to the reconfigurable parasitic pixel layer though electromagnetic mutual coupling. The reconfigurable parasitic pixel surface and the active antenna may be physically separated (e.g., via a dielectric material or air) such that there is no conductive connection between them.

The pixels of the reconfigurable parasitic pixel surface may be interconnected using microelectromechanical system (MEMS) switches. In some embodiments, the MEMS switches may allow for monolithic integration capability with antenna segments and exhibit low loss. Activation of the MEMS switches may allow the surface geometry of the parasitic layer to be modified, thereby varying the mode of operation of the MRA.

In certain embodiments, to improve RF power handling capability, the switches may be physically separated from the driven antenna, thereby allowing the switches to be exposed to only a minor portion of the RF power available on the driven antenna surface. Further, separating the switches from the driven antenna may reduce any deleterious coupling affect that may detrimentally impact antenna performance. In certain embodiments, the driven antenna and the parasitic layer may be designed separately allowing the design of each to be optimized to meet overall system level performance requirements. Further, by separating the parasitic layer from the driven antenna, the parasitic layer may be more easily fabricated. Any suitable distance may separate the driven antenna and the reconfigurable pixel surface. For example, the driven antenna and the reconfigurable pixel surface may be separated by a distance corresponding to the thickness of a MEMS compatible quartz substrate (e.g., 0.525 mm) or any suitable distance that ensures a good impedance match (e.g., approximately $\lambda/4$ of a central wavelength).

The MRA may be designed in part using Multi-Objective Genetic Algorithm (GA) optimization. In certain embodiments, the GA optimization may search for an optimal solution by maintaining a population of solutions from which better solutions are created. By progressively accepting a better set of solutions, electromagnetic and antenna calculations that are numerically intensive may be solved relatively quickly using GA optimization methods.

FIG. 1 illustrates an exploded view of an example MRA 100 consistent with embodiments disclosed herein. As illustrated, the MRA 100 may comprise at least two layers including a patch layer 102 and a parasitic layer 104. The patch layer 102 may include a driven patch antenna 106 element and portions of highly resistive bias lines 108. The patch layer 102 may be built on a quartz substrate (e.g., a quartz substrate having $\in_r=3.0$, tan $\delta=0.0002$). In certain embodiments, the patch layer 102 may be approximately $60\times60\times1$ mm$^3$, although other dimensions are also contemplated. Although the illustrated MRA 100 includes a patch antenna 106, any suitable active antenna element may also be utilized. For example, a dipole antenna, a monopole antenna, a slot antenna, a Yagi-Uda antenna, or any other suitable antenna design may be used as an active antenna element.

In some embodiments, the patch layer 102 and the parasitic layer 104 may be fabricated separately and bonded together during construction. The patch layer 102 and the parasitic layer 104 may be formed by etching (e.g., chemical etching) a conductive metal (e.g., gold) deposited on quartz substrates using an electron beam deposition tool or other suitable process. In certain embodiments, the thicknesses of the quartz substrates of the patch and parasitic layers may be 1.00 and 0.525 mm, respectively.

The resistive bias lines 108, through which DC control voltages for actuation of the MEMS switches 110 may run from the MEMS switch locations on the parasitic layer 104 to bias pads located on the patch layer 102. In certain embodiments, the transition of the highly resistive bias lines 108 from the parasitic layer 104 to the patch layer 102 may comprise a wedge type of wire bond. For example, aluminum wire bonds having a diameter of 0.025 mm may be utilized, although any other suitable type of bond or size of bond may also be used.

In some specific embodiments, the driven patch antenna 106 may be designed to operate at approximately 5.2 GHz and be fed by a microstrip feed line 114 having a 50Ω characteristic impedance. The parasitic layer 104, which in certain embodiments may have dimensions of $32\times24\times0.525$ mm$^3$, may be disposed on the top of the patch layer 102. The parasitic layer 104 may include a grid (e.g., a 5×5 grid) of electrically small metallic pixels 112 configured to be electrically coupled in various configurations using one or more MEMS switches 110. The metallic pixels 112 may, in some embodiments, be sized 4.8×3.6 mm, although any other suitable size may also be used. In certain embodiments, the vertical distance between the patch antenna element 106 and the reconfigurable pixel surface 112 may be 0.525 mm, which may be determined by the substrate thickness of the parasitic layer 104.

Figure 2:
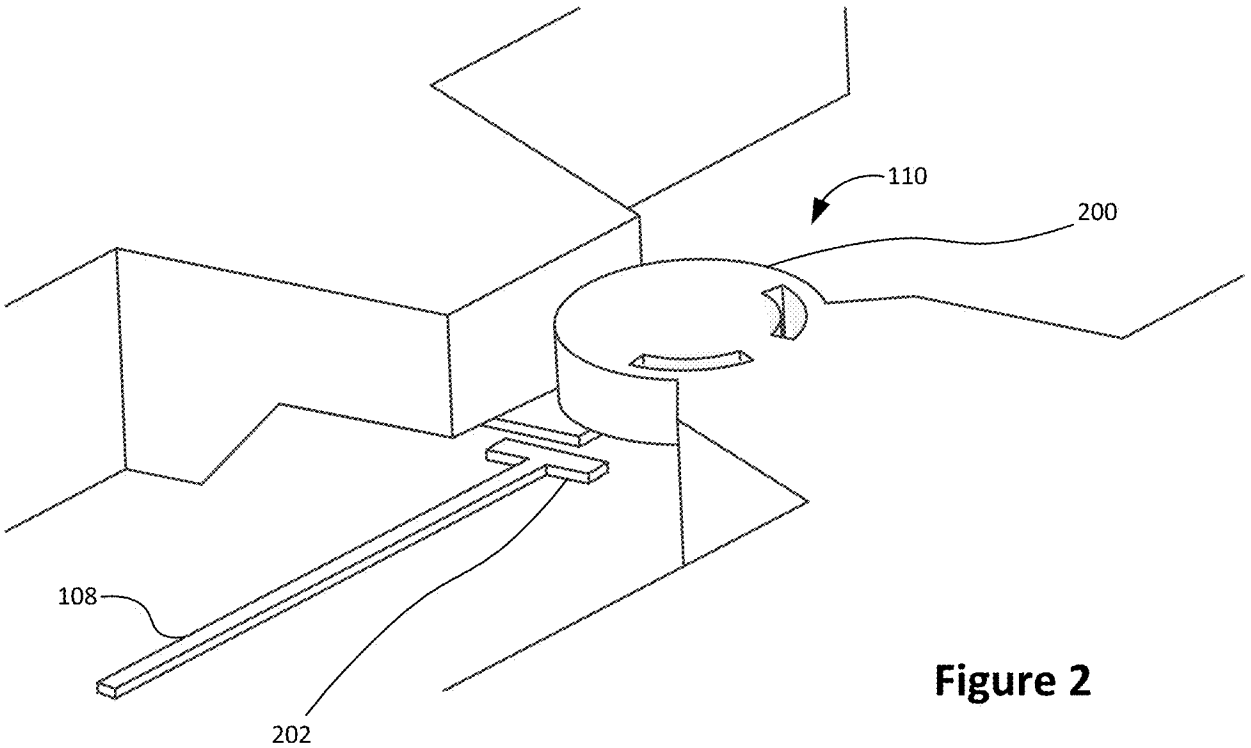
FIG. 2 illustrates a microelectromechanical system (MEMS) switch used in actuating a parasitic pixel array.

FIG. 2 illustrates a MEMS switch 110 used in actuating a parasitic pixel array (e.g., array 112) consistent with embodiments disclosed herein. Although FIG. 2 illustrates a particular architecture of a MEMS switch 110, any suitable switching mechanism may be utilized to perform the pixel array switching operations disclosed herein. In certain embodiments, the MEMS switch may be a DC contact type MEMS switch. For example, as illustrated, in some embodiments, the MEMS switch 110 may comprise a circular metallic membrane 200 suspended over an actuation electrode 202 to which a DC control voltage is applied. In certain embodiments, the metallic membrane 200 may be comprised of gold or a similarly conductive material. The applied DC voltage may create an electrostatic force between the membrane 200 and the bias electrode 202. When the electrostatic force overcomes the static force holding the membrane 200 in place, the membrane 200 may move down and make a DC contact with the bias electrode 202, thereby electrically coupling the pixels 112. When no DC voltage is applied, the pixels 112 may be disconnected.

In some embodiments, the DC control voltages may be applied to the switches 110 via the highly-resistive bias lines 108 which, in certain embodiments, may be comprised of Tantalum Nitride (Tan) with a sheet resistance of approximately 10 kΩ/square and a typical absolute resistance of 600 kΩ, although any other suitable conductive material may also be utilized. Utilizing highly-resistive bias lines 108 may reduce deleterious coupling effects of electromagnetic (EM) energy on the pixels 112.

In certain embodiments, the MRAs disclosed herein may utilize the principle of reactively controlled directive arrays to achieve reconfigurability. Utilizing this principle, the radiation characteristics of an antenna system (e.g., a system including a driven antenna element and a number of parasitic elements) may be controlled by impedance loading of the parasitic elements. The impedance loading may occur due to the EM energy generated by the driven antenna, which may couple to the parasitic elements via EM mutual coupling. When the parasitic elements are loaded with appropriate reactive loads, the surface current on the elements can resonate, resulting in radiation at a given direction with high gain. In other words, the induced currents on the parasitic elements may increase as their sizes approach the resonant size.

In certain embodiments, interactions between parasitic elements and the driven element can be described in terms of mutual impedances with every element being assigned a port.

In certain embodiments, the mutual impedance between the ports of an element "i" and an element "j" may be represented by Equation 1:

$$Z_{ij} = \frac{V_i}{I_j}\bigg|_{I_i=0, i\neq j} \tag{1}$$

where $V_i$ is the voltage applied to the port of element i and $I_j$ is the current induced on the element j when all the ports but the $j^{th}$ port is open circuited. When the applied voltages $V_i$ are known, the mutual impedances can be calculated independently, and the currents in each element can be calculated to obtain the total radiated E-field, which may be represented by Equation 2:

$$E_{tot}=\Sigma_i E(I_i) \tag{2}$$

where $E(I_i)$ is the field produced by $I_i$.

In the parasitic layer, the mutual impedances, or equivalently reactive loads, can be varied by changing the shapes and relative locations of the parasitic elements (e.g., by switching on and off the interconnecting switches), which may result in one or more (e.g., infinite) modes of operation. For example, in one specific embodiment, there may be nine modes of operation corresponding to three beam steering angles $\theta_i$=−60°, 0°, and 60° and three polarizations $P_j$=Linear, Circular, and Elliptical. In other embodiments, a reconfigurable antenna may be configured to operate in any suitable beam steering angle or a beam steering angle selected from a particular range (e.g., from $\theta_i$ between −60° and 60° any fractional angle in between). Similarly, a reconfigurable antenna consistent with embodiments disclosed herein may be designed to operate in any number of linear polarizations (e.g., in any vertical and horizontal component to a linear vector), at least two circular polarizations (e.g., right and left-hand circular polarizations), and any number of elliptical polarizations, that may vary in length, width, or direction.

In certain embodiments, the associated total radiated E-fields can be expressed by Equation 3:

$$E_{tot}=\Sigma_{i,m} E(I_{i,m}),\ m=1, 2, \ldots 6 \tag{3}$$

where m represents a mode of operation.

The reconfigurable radiation characteristics of the MRAs disclosed herein may also be attributable to surface waves existing on the parasitic layer. Surface waves generally may be deleterious for microstrip antennas due in part to a reduction in radiation efficiency and an introduction of radiation pattern perturbations, which may result from the diffraction of surface waves at the edge of the antenna structure in an uncontrolled manner. An exemplary rectangular patch designed to operate as a launch for surface waves may have a substrate thickness t chosen according to Equation 4:

$$t > \frac{c}{4f\sqrt{\varepsilon_r - 1}} \tag{4}$$

where c is the velocity of light in free space, f is the cutoff frequency for the surface wave mode, and $\in_r$ is the effective permittivity of the dielectric substrate used.

The electric field of a TM polarized surface wave propagating along the metal-dielectric interface of the patch antenna in the +x direction with a propagation constant k and decay factor α in the +z direction can be expressed according to Equation 5:

$$E=E_z e^{jwt-jkx-az} \tag{5}$$

The surface impedance of a flat metal sheet may be derived according to Equation 6:

$$Z_S = \frac{1+j}{\sigma\delta} \tag{6}$$

where δ is the skin depth due to surface wave penetration and σ is the conductivity of the metal. To suppress surface wave propagation in the patch antenna, thereby improving system performance, a high-impedance electromagnetic (HIEM) surface having a periodic structure can be used. In certain embodiments, the periodicity in the metallic surface may provide impedance at one or more specific frequency bands, which may be used to suppress surface waves launched by the patch antenna. In some embodiments, the HIEM surface may be modeled to a parallel LC resonant circuit, where vertical vias and the gaps between adjacent metallic pixels may provide the inductance and capacity. Thus, the equivalent surface impedance of a HIEM surface may be expressed according to Equation 7:

$$\tilde{Z}_S = \frac{j\omega L}{1-\omega^2 LC} \tag{7}$$

which may become high at a resonant frequency $$\omega_o = \frac{1}{\sqrt{LC}}.$$

Figure 3:
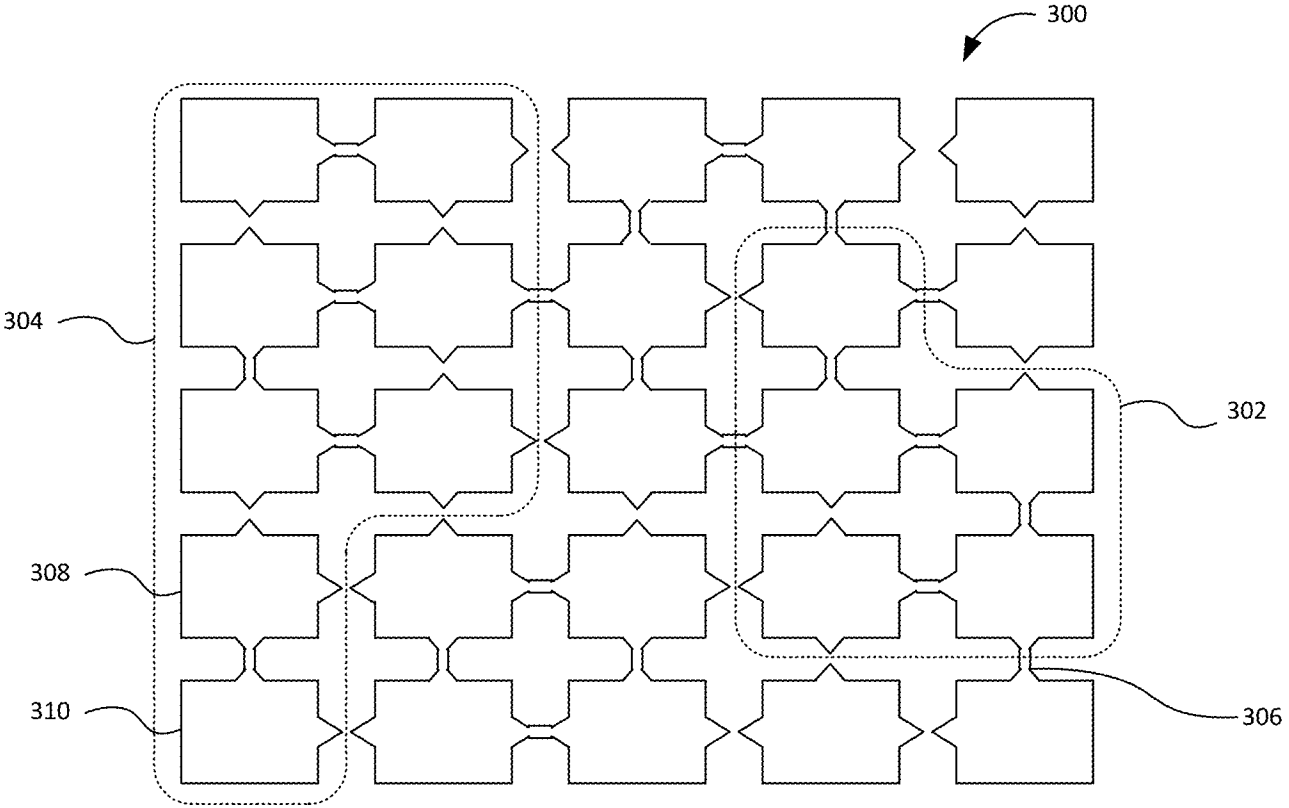
FIG. 3 illustrates an exemplary reconfigurable parasitic pixel surface.

FIG. 3 illustrates an exemplary reconfigurable parasitic pixel surface 300 consistent with embodiments disclosed herein. Reconfiguring the geometry of the parasitic pixel surface 300 by means of switching, may yield one or more parasitic elements 302, 304. The surface impedance of the parasitic elements 302, 304 may vary depending on their shapes and locations relative to the driven patch antenna. Accordingly, while surface waves may propagate over some parasitic elements 302, 304, they may be suppressed by others. The parasitic pixel surface 300 may thus act as a reconfigurable HIEM surface of which surface impedances over various regions can be varied.

The reconfigurable pixel surface 300 illustrated in FIG. 3 is configured in one exemplary beam steering mode (e.g., θ=30°, P=Linear). Different surface impedances may exist over different parasitic elements 302, 304 (e.g., regions of the parasitic layer). According to Equation 7, surface waves may be supported by regions with lower surface impedance that are not in resonance, and may be suppressed by high impedance regions which are in resonance.

In certain embodiments, an exemplary MRA consistent with embodiments disclosed herein may achieve both beam steering and improved gain by approximately 1 dB over that of a legacy patch antenna. The interaction among the parasitic elements with different surface impedances may also influence reactive loading, which may impact the mode of operation of the MRA. Reconfiguring the switches in a low impedance area of the parasitic layer that exhibits strong surface waves may affect the reactive loading of the associated parasitic elements and the radiation properties of the MRA. For example, changing the status of switch 306 illustrated in FIG. 3, from an ON status to an OFF status may cause a corresponding change in the input impedance. Pixel elements 308, 310, illustrated in FIG. 3, may exhibit high surface impedance and thus may not significantly impact reactive loading.

The surface geometry of a parasitic layer consistent with embodiments disclosed herein may be reconfigurable based on the number of metallic pixels (e.g., a 5×5 pixel grid in a square pattern) and interconnecting switches. Consistent with embodiments disclosed herein, other suitable pixel array shapes and configurations may also be utilized. Accordingly, the parasitic layer may be reconfigured to provide for a large number of parasitic elements having various shapes and locations, thereby enabling operation in multiple modes.

In certain embodiments, MRAs disclosed herein may be designed in part using a multi-objective GA. In certain embodiments, the multi-objective GA may determine a solution vector of decision variables (e.g., $x=[x^*_1, x^*_2, \ldots x^*_d]$). The solution vector may satisfy certain constraints to produce optimal values for object functions $obf_i(x)$, i=1, 2 . . . m. Equation 8 reflects exemplary optimal values and constraints:

$$\text{Minimize(Maximize)} obf_i(x),\ i-1, 2 \ldots m$$

$$\text{Subject to } g_j(x)\leq 0 (g_j(x)\geq 0) j=1, 2 \ldots n$$

$$h_k(x)=0,\ k=1, 2 \ldots z\ l\leq x\leq u \tag{8}$$

where $obf_i(x)$ are objective functions to be optimized, $g_j(x)$ and $h_k(x)$ are inequality and equality constraint functions, and l and u vectors represent lower and upper bounds, respectively.

The multi-objective GA may lead to a set of non-dominated solutions, known as pareto optimal solutions, wherein objectives corresponding to any point along a pareto optimal front can be improved by degradation of at least one of the other objectives. The multi-objective GA may utilize the concept of domination, where a solution $x_i$ is said to dominate another solution $x_j$ if the following conditions are true: (i) the solution $x_i$ is not worse than $x_j$ in all objectives; and (ii) the solution $x_i$ is strictly better than $x_j$ in at least one objective.

Figure 4:
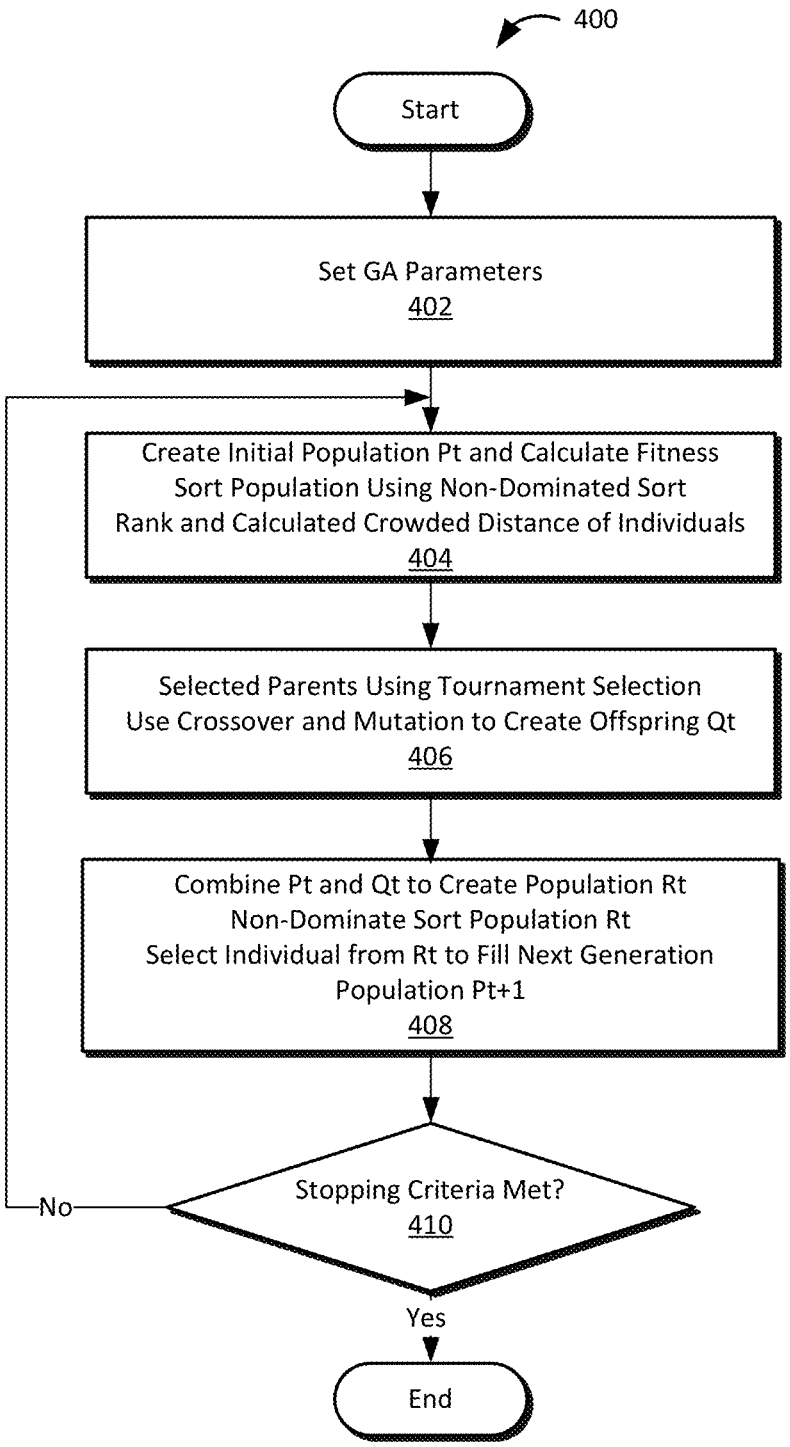
FIG. 4 illustrates a flow chart of a method for implementing a non-dominated sorting genetic algorithm (NSGA)

In certain embodiments, the MRA disclosed herein may be designed in part using the non-dominated sorting genetic algorithm (NSGA) II. FIG. 4 illustrates a flow chart of a method 400 for implementing a NSGA consistent with embodiments disclosed herein. At 402, the algorithm may start with a set of solution parameters denoted as a population. The parameters may be represented by a chromosome, whereby each parameter is encoded in a binary string or real value called a gene. In the absence of any indication regarding a solution, at 404, an initial population $P_t$ may be randomly created using a uniform distribution with size N.

Chromosomes of the population may be sorted into different front levels based on the domination of a pair comparison. The front levels may be assigned a fitness or rank, which may represent its non-domination level. For example, Level 1 may be a top level wherein an individual is dominated by no other individuals, and Level 2 may be a second level wherein an individual is dominated only by Level 1 individuals.

Within a single front level, the location of a finite number of solutions may be distributed relatively uniformly. Accordingly, a large diversity of the individuals in a level may prevent the results from trapping into a local optimum. Another feature called crowding distance may be adopted to evaluate the local aggregation of individuals. Particularly, the crowding distance may be a measure of how close an individual is to neighboring individuals. Large average crowding distance may result in better diversity in the population.

To calculate a crowding distance value, individuals on the front may be sorted for every $m^{th}$ objective by a Sort($f_i$,m) function, where $f_i$ may represent the set of individuals on the $i^{th}$ front. Boundary individuals at each pareto front ($F_i$) may be assigned infinite value such as $d_i=\infty$ and $d_n=\infty$, where $d_i$ is the crowding distance value of the $i^{th}$ individual, and n is the number of individuals at pareto front $F_i$. The crowding distance value may be calculated according to Equation 9 as follows:

$$d_k = \sum_{k=2}^{n-1} \sum_{m=1}^{N_{obj}} \frac{obf_{k+1}^m - obf_{k-1}^m}{obf_m^{max} - obf_m^{min}} \tag{9}$$

where $obf_k^m$ is the fitness value of the $m^{th}$ objective of the $k^{th}$ individual at pareto front F and $N_{obj}$ is the number of objectives.

After each pareto front is ranked and a crowded distance is calculated, at 406, binary tournament selection may be used to select parents to produce offspring. An individual from a pareto front with a higher rank value may be selected for reproduction. If the rank values of individuals are the same, the individual with a larger crowding distance may be selected. The selected population may generate offspring ($Q_t$) by using crossover and mutation operators with a user-definable mutation probability ($p_m$). At 408, the current generation population ($P_t$) may be combined with the offspring population ($Q_t$) to produce a temporary population ($R_t$). Since all the previous and current best individuals may be added in the population, elitism may occur. After a combining process, new temporary populations may be sorted based on non-domination. The population of the next generation ($P_{t+1}$) may be filled by individuals at each pareto front of $R_t$ in a subsequent manner, until the population size exceeds the current population size.

The algorithm execution may terminate when the number of generations exceeds a predefined maximum number, the fitness values fall below an anticipated threshold, or there is little improvement in solution in successive integrations. In this manner, NSGA-II converges to an optimal pareto-optimal front of non-dominated solutions.

In applying NSGA-II to the MRA optimization problem, the problem may be structured as a combinatorial optimization, whose parameters are the states of interconnecting switches (on="1" or off="0"), placed between adjacent metallic pixels of the reconfigurable parasitic pixel surface. In certain embodiments, the surface may comprise of a grid of 5×5 pixels having 40 switches and $2^{40}$ possible switch state permutations to be tested in a search space.

Figure 5:
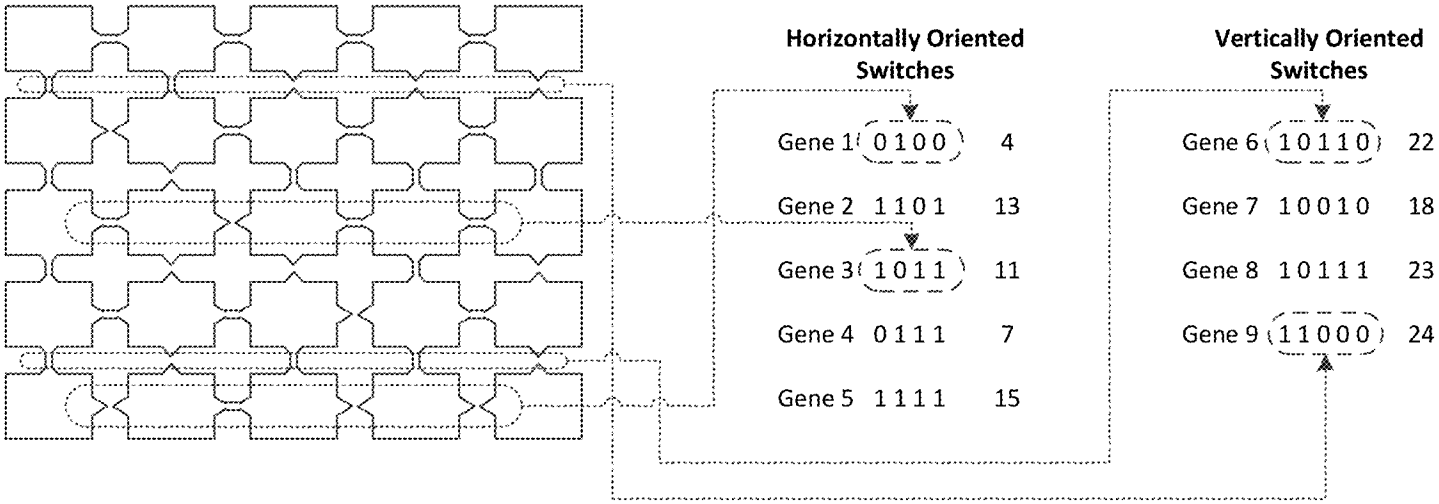
FIG. 5 illustrates a binary and real value representation of the chromosome structure of an exemplary reconfigurable parasitic pixel surface.

The optimization process may begin with coding the design patterns. FIG. 5 illustrates a binary and real value representation of the chromosome structure of an exemplary reconfigurable parasitic pixel surface consistent with embodiments disclosed herein. Each chromosome vector may have 9 genes, which are bounded real values, in order to avoid out of range values when mutation and crossover operations are performed. The first 5 genes (bounded between 0 and 15) represent each row of horizontally oriented switches, where each row has 4 switches (e.g., 4 bits). Similarly, the rest of the 4 genes (bounded between 0 and 31) correspond to vertically oriented switches, where each row has 5 switches (e.g., 5 bits). Following coding the design patterns, multi-objective functions may be determined allowing the evaluation of the solutions, which may be the desired switch configurations that achieve certain desired functionalities. For example, in certain embodiments, desired functionalities may include: (a) tilt gain in multiple directions of arrival ($\theta_i$=−60°, 0°, 60°), (b) desired frequency bandwidth of approximately 3% around a center frequency, or (c) targeted polarization types ($P_j$=Linear, Circular, Elliptical). The center tilt angle, or primary beam steering angle, e.g., $\theta_i$=0°, may be in any direction (e.g., 0 to 360°) and the tilt gain may be selected based at least in part on the center tilt angle. Tilt gain may be selected from a range between $\theta_i$=−60° and $\theta_i$=60 (e.g., −60°, −59°, −58°, . . . −3°, −2°, −1°, 0°, 1°, 2°, 3°, . . . 58°, 59°, 60°) or any fractional angle in between. Similarly, while the polarizations may be linear, circular, or elliptical, there may be any number of linear polarizations (e.g., any vertical and horizontal component to a linear vector), at least two circular polarizations (e.g., right and left-hand circular polarizations), and any number of elliptical polarizations that may vary in length, width, or directions.

In certain embodiments, multi-objective functions having solutions representing switch configurations that achieve certain desired functionalities may be determined based on fixing a particular desired antenna parameter and allowing for reconfigurability of other desired antenna parameters. For example, a multi-objective function may include a fixed desired antenna operating frequency and variable antenna operating direction and polarization. Similarly, a multi-objective function may include a fixed desired antenna operating direction and variable operating frequency and polarization. In further embodiments, a multi-objection function may not include fixed desired antenna parameters.

Figure 6A:
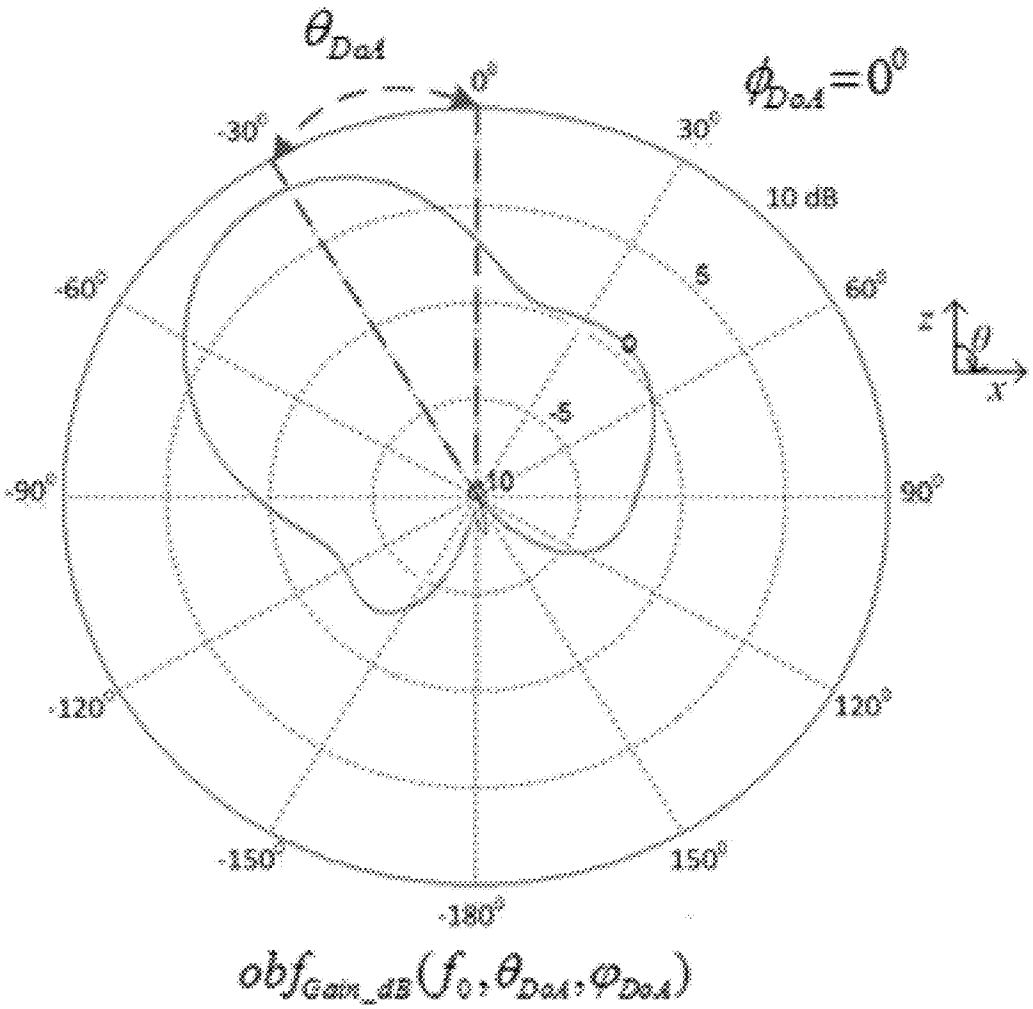
FIGS. 6A-6C illustrate exemplary objectives for an optimization problem.
Figure 6B:
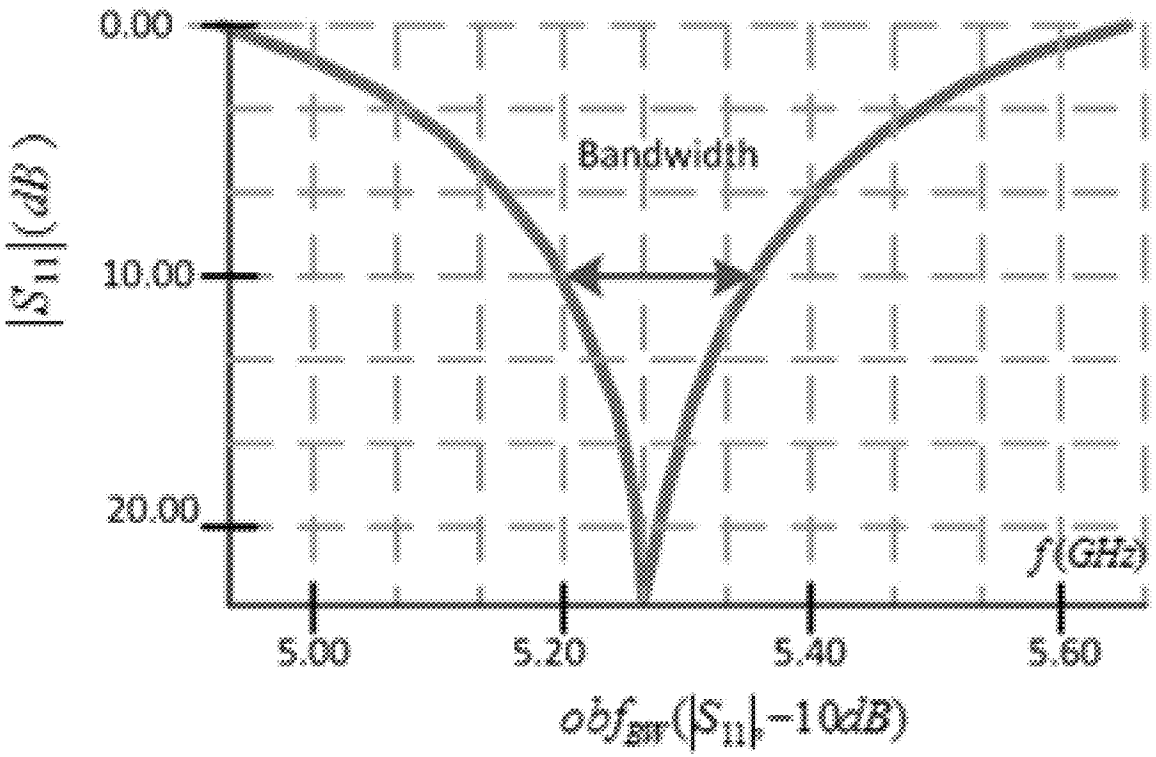
Figure 6C:
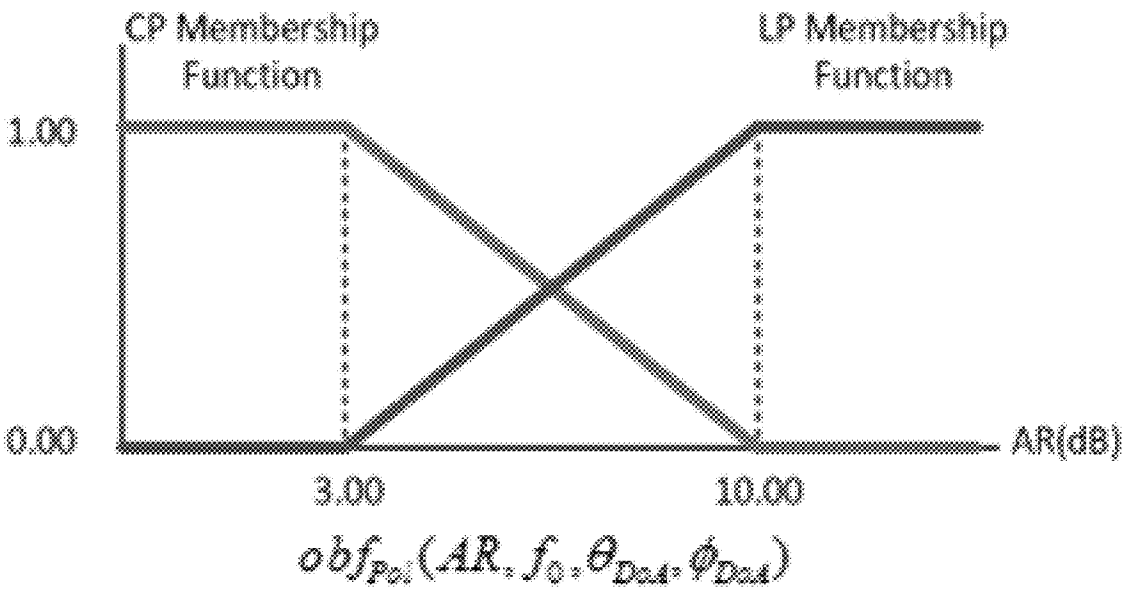

FIGS. 6A-6C illustrate exemplary objectives for an optimization problem consistent with embodiments disclosed herein. The corresponding objective functions may be reflected in Equation 10:

$$\mathrm{obj}_1=\mathrm{obf}_{Gain_dB}(f_0,\theta_{DoA},\phi_{DoA})$$

$$\mathrm{obj}_2=\mathrm{obf}_{BW}(|S_{11}|,-10\ \mathrm{dB})$$

$$\mathrm{obj}_3=\mathrm{obf}_{Pol}(AR,f_0,\theta_{DoA},\phi_{DoA}) \tag{10}$$

where $f_0$ is the expected frequency, $\theta_{DoA}$ and $\phi_{DoA}$ describe the title direction as defined in FIGS. 6A-6C, AR is the axial ration for polarization $|S_{11}|$ which represents the magnitude of the reflection coefficient.

The function $\mathrm{obf}_{Gain_dB}$ may yield a maximum realized gain at the given frequency and direction of arrival. The function $\mathrm{obj}_1$ may provide the realized gain, taking into account losses due to input impedance mismatch. The function $\mathrm{obf}_{BW}$ may give the range of frequencies for which $|S_{11}|$ satisfies VSWR≤2. In certain embodiments, using a range of frequencies as opposed to a minimum reflection coefficient at a single frequency may avoid misleading effects on fitness due to patch antennas generally exhibiting narrow bandwidth with loss $|S_{11}|$. Similarly, rather than using a single AR value in determining the status of polarization in the function $\mathrm{obj}_3$, the value may be fuzzified by using the function $\mathrm{obf}_{Pol}$ presented below in Equation 11:

$$obj_{Pol}=\begin{cases} 0 & AR\le 3\mathrm{dB} \\ -\frac{1}{7}(AR-10) & 3\mathrm{dB}\le AR\le 10\mathrm{dB} \\ 1 & AR\ge 10\mathrm{dB} \end{cases} \tag{11}$$

For circulation polarization, the $\mathrm{obf}_{Pol}$ function may be given by Equation 10, whereas for linear polarization the compliment of Equation 10 may be used.

Corresponding to three directions of arrival ($\theta_i$=−60°, 0°, 60°) and two polarization types ($P_j$=Linear and Circular), six optimization problems may be defined. For example, in certain embodiments, the optimization problems may be solved with GA parameters listed in table I, presented below:

TABLE I

Exemplary NSGA-II Running Parameters

| Parameters | Value |
|---|---|
| Number of variables (chromosome length) | 9 |
| Population | 40 |
| Generation | 30 |
| Mutation Rate | 0.1 |
| Tournament Level | 2 |
| Distance Function | Crowding Distance (Eqn. 9) |

Each problem may have a pareto optimal surface that contains more than one solution satisfying desired antenna functionalities. For example, in certain embodiments, desired functionalities may include: (a) tilt gain in multiple directions of arrival ($\theta_i$=−60°, 0°, 60°), (b) desired frequency bandwidth of approximately 3% around a center frequency, and (c) targeted polarization types ($P_j$=Linear, Circular, Elliptical), although other desired functionalities are also contemplated.

The center tilt angle, or primary beam steering angle may be in any direction (e.g., 0 to 360°) and the tilt gain may be selected from based on the center tilt angle. Tilt gain may be selected from any angle between $\theta_i$−60° and 60° (e.g., −60°, −59°, −58°, . . . −3°, −2°, −1°, 0°, 1°, 2°, 3°, . . . 58°, 59°, 60°) or any fractional angle in between.

A patch antenna may be designed with a center frequency that operates in the IEEE-802.11 WLAN standard (e.g., in the 5-6 GHz range). Alternatively, an antenna may be designed to operate with a center frequency from 0.1 GHz to 10^12 Hz, or any frequency in between. Once the center frequency has been selected, the frequency bandwidth may change +/−20%. For example, a patch antenna with a center frequency of 5 GHz may have a frequency bandwidth from 4 to 6 GHz. To select optimal designs for implementation among these pareto-optimal surfaces, the common frequency BW may be accounted for in conjunction with realized maximum gain.

Similarly, while the polarizations may be linear, circular, or elliptical, there are an infinite number of linear polarizations (e.g., any vertical and horizontal component to a linear vector), two circular polarizations (e.g., right and left-hand circular polarizations), and an infinite number of elliptical polarizations that may vary in length, width, or direction.

Figure 7:
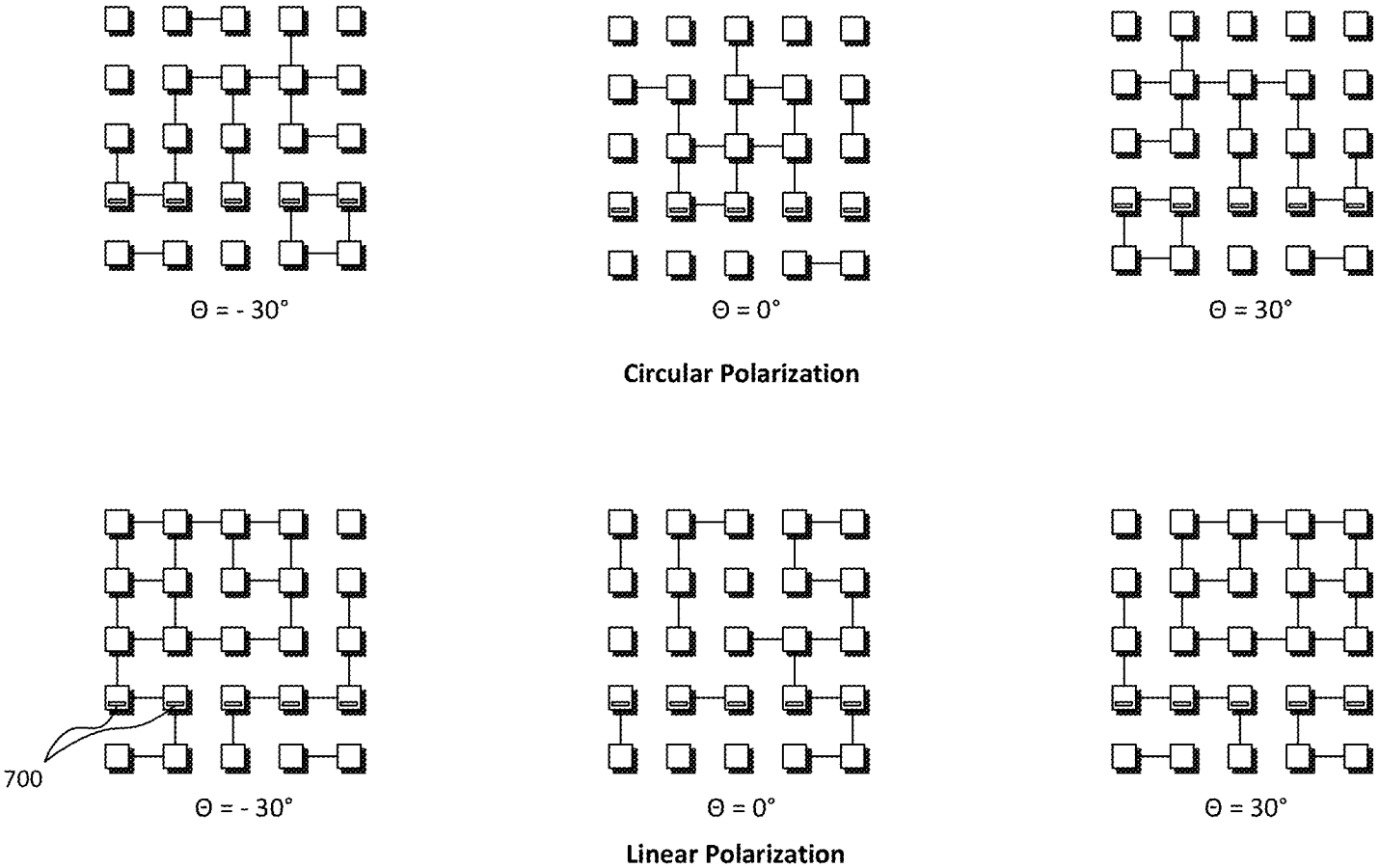
FIG. 7 illustrates geometries of a reconfigurable parasitic pixel surface under six exemplary operating modes.

FIG. 7 illustrates geometries of a reconfigurable parasitic pixel surface under six exemplary operating modes consistent with embodiments disclosed herein. Particularly, FIG. 7 illustrates geometries of an exemplary reconfigurable parasitic pixel surface under three different beam directions and two polarizations. As illustrated, in certain embodiments, certain pixels of the parasitic array may include slits 700 or other suitable apertures (e.g., rectangular slits). These slits 700 may be useful in obtaining circular polarizations, where two orthogonal E-field components with 90° phase difference between them can be excited.

In an exemplary MRA consistent with embodiments disclosed herein, the center frequency for the different modes of operation of the antenna may be approximately 5.25 GHz with a common frequency bandwidth of approximately 1%. The realized gain (e.g., the maximum realized gain) for all modes of operation for an exemplary antenna may be approximately 8 dB. In certain embodiments, the instantaneous variable bandwidth around a center frequency for an exemplary antenna may be approximately 3%. In further embodiments, an antenna may be capable of a change of operating frequency from approximately ±20% around a center frequency (e.g., a center frequency of 5 GHz).

Table II, presented below, provides axial ration values of an exemplary MRA showing that linear and circular polarizations may be obtained for all operational modes.

TABLE II

Exemplary Axial Rations for Different Beam Directions at 5.25 GHz

| Parameters | −30° | 0° | 30° |
|---|---|---|---|
| LP | 27.5 | 18.5 | 26.8 |
| CP | 1.7 | 5.1 | 1.7 |

MRAs consistent with embodiments disclosed herein may also be utilized in a multifunctional reconfigurable antenna array (MRAA) design. For example, multiple individual MRAs can be arranged in an array fashion to form an MRAA. Whereas a standard linear antenna array may have a fixed element factor and a radiation pattern controlled primarily by the array factor determined by the geometrical position of the radiators forming the array and their excitations, an MRAA may have a variable element factor, presenting an additional degree of freedom in providing agile array properties in frequency, polarization and radiation pattern as compared to a standard antenna array.

In certain embodiments, an MRAA may include one or more equally spaced MRAs (e.g., 4×1 MRAs) that may act as individual radiators of the array. In some embodiments, each MRA of the MRAA may include an aperture-coupled fed patch antenna with a parasitic layer disposed above it. Each MRA element of the MRAA may be configured to operate in a plurality of operating modes. For example, each MRA of the MRAA may produce eight modes of operation corresponding to three steerable beam directions (e.g., $\theta_{xz}$=−30°, 0°, 30°) with linear and circular polarizations in the x-z plane and another two steerable beam directions (e.g., $\theta_{yz}$=−30°, 30°) in the y-z plane with linear polarization.

In some embodiments, an exemplary MRAA may have an operation frequency range of 5.4-5.6 GHz. The surface of the parasitic layer of each MRA may include a grid of electrically small rectangular-shaped metallic pixels (e.g. a 4×4 grid), where adjacent pixels can be connected/disconnected by means of switching. As discussed above, the reconfigurability in beam-direction and polarization may be accomplished by modifying the geometry of the parasitic pixel surface. In certain embodiments, an exemplary MRAA may exhibit approximately 13.5 dB gain and approximately 3% common bandwidth in all modes of operation. The MRAA may alleviate scan loss inherit to standard antenna arrays, provide higher gain, not require phase shifters for beam steering in certain planes, and be capable of polarization reconfigurability.

In certain embodiments, full-wave analysis and multi-objective GA optimization may be jointly employed to determine the status of interconnecting switches (e.g., short or open circuit) of the individual parasitic pixel layers of the MRAA corresponding to eight modes of operation. Embodiments of the MRAA disclosed herein may perform beam steering in both the x-z and y-z planes. Beam steering in the x-z plane may be achieved by the variable element factor of the MRAA without needing to employ phase shifters, reducing issues such as scan loss and beam-squint associated with a progressive phase shift between array elements. Beam steering in the y-z plane may be achieved by the variable element factor in conjunction with the array factor of the MRAA. In certain embodiments, the main beam direction of each individual radiator may be aligned with a maximum array factor, thereby causing an increase in array gain. Embodiments of the disclosed MRAA may be utilized to enhance the capabilities of IEEE 802.11a, b, g, n, and ac systems. In particular, IEEE 802.11n and IEEE 802.11ac MIMO systems equipped with MRAA can provide significant performance improvement over a MIMO system employing single-function antennas.

Figure 8:
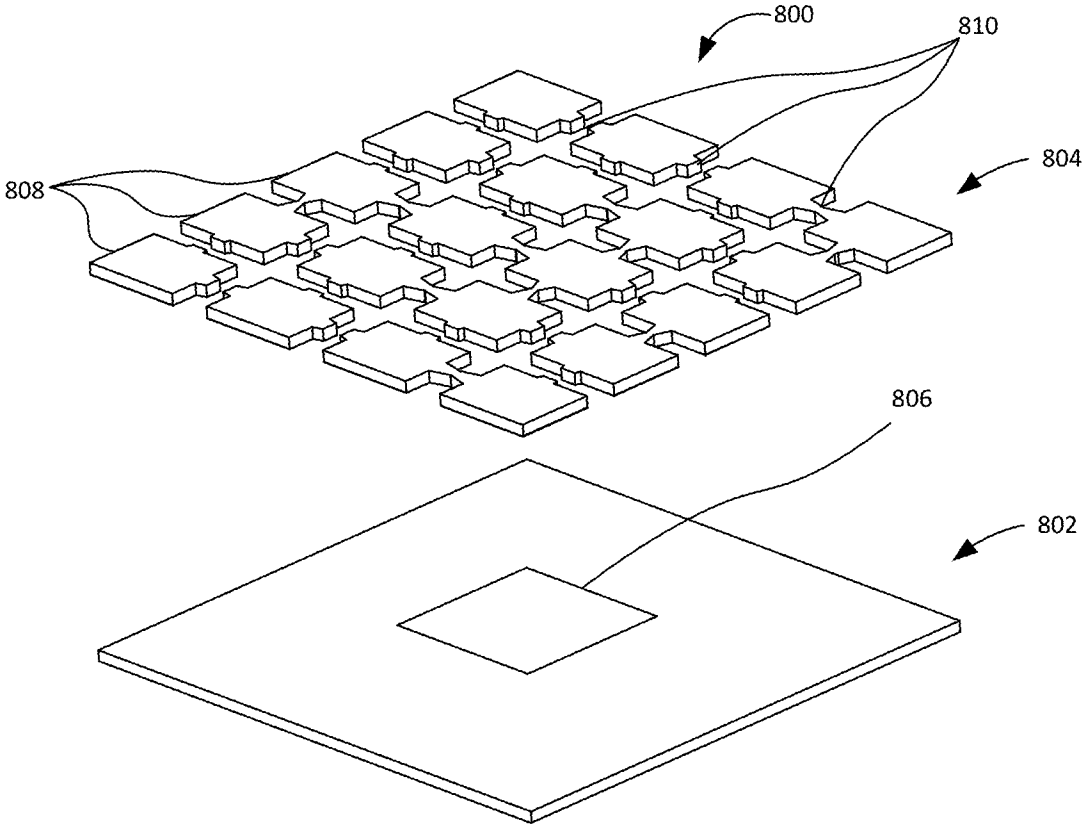
FIG. 8 illustrates an exploded view of another reconfigurable antenna.
Figure 9:
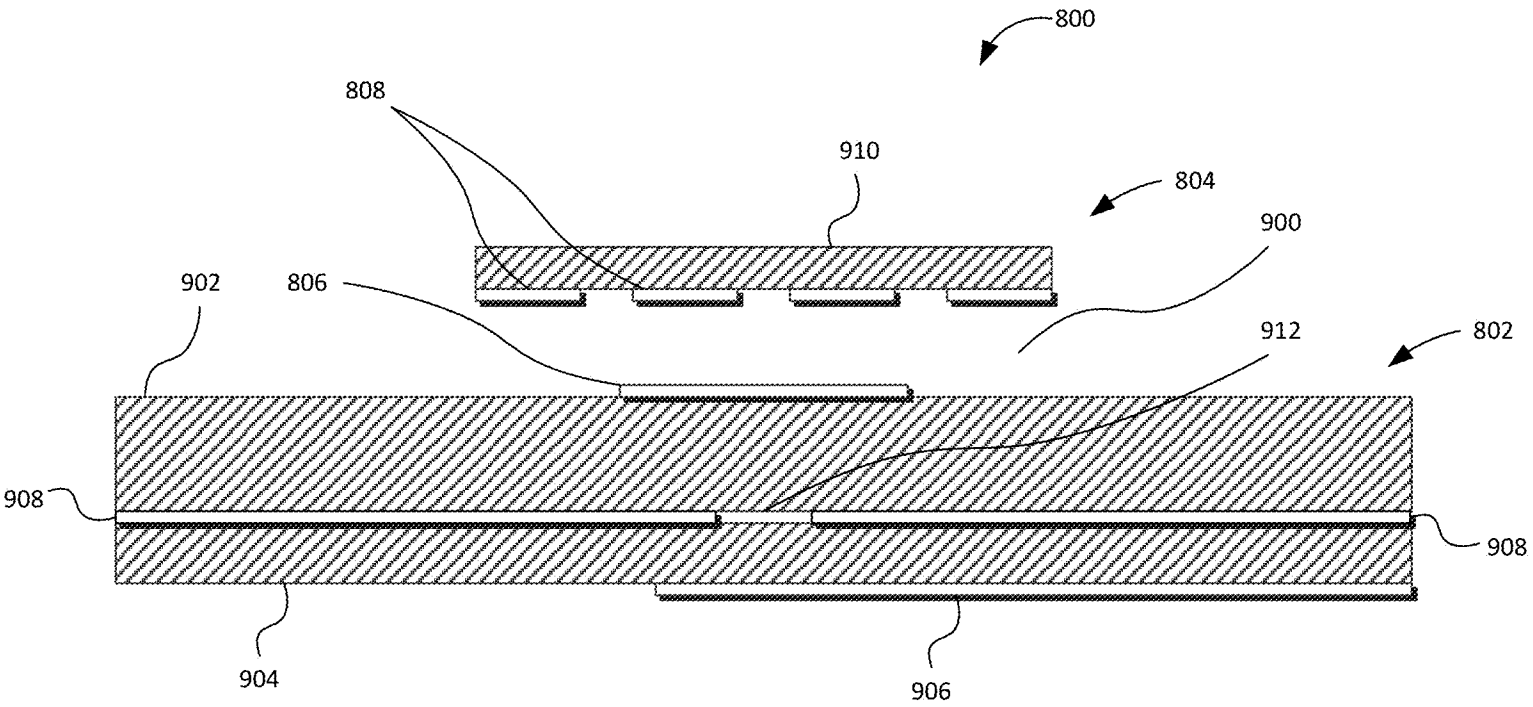
FIG. 9 illustrates a cross section view of a reconfigurable antenna.

FIG. 8 illustrates an exploded view of another MRA 800 consistent with embodiments disclosed herein. In certain embodiments, the MRA illustrated in FIG. 8 may be similar to the MRA illustrated and described in reference to FIG. 1. FIG. 9 illustrates a cross sectional view of the MRA 800 illustrated in FIG. 8. As illustrated, the MRA 800 may comprise at least two layers including a patch layer 802 and a parasitic layer 804. The patch layer 802 may include a driven patch antenna 806. The MRA 800 may include an air or foam substrate 900 between the patch layer 802 and the parasitic layer 804. In certain embodiments, the MRA 800 may include physical separators or spacers between the patch layer 802 and the parasitic layer 804 to maintain the spacing of the air substrate 900.

The patch layer 802 of the MRA 800 may be fed with an aperture-coupled feed mechanism employing an aperture 912 disposed under the patch antenna 806 and a patch substrate 902. A ground plane 908 may define the aperture 912. The aperture 912 may be separated from a feeding line 906 by a feed substrate 908. In certain embodiments, the geometry of the MRA 800 may be symmetric along x- and y-axes, which may simplify the optimization procedure of determining the modes of operation.

The driven patch antenna 806 in certain embodiments may be 18×13 $mm^2$ and may be designed to operate at approximately 5.4 GHz, although other dimensions and operating frequencies, including suitable ranges of dimensions and operating frequencies (e.g., 4-6 GHz), are also contemplated. The feeding line 906 may be 50-Ohm microstrip line, and the aperture 912 may be 7×0.7 $mm^2$. The feed substrate 908 may be 60×60×0.508 $mm^3$ and the patch substrate 902 may be 60×60×1.524 $mm^3$. The feed substrate 908 and the patch substrate 902 may be constructed using any suitable substrate material (e.g., a quartz substrate or a RO4003C substrate having $\epsilon_r$=3.55, tan δ=0.0021).

The parasitic layer 804 may include a parasitic substrate 910 that may be constructed using the same or similar materials. The parasitic layer 804 may include one or more conductive (e.g., metallic) parasitic pixels 808. In certain embodiments, the parasitic substrate 910 may be 32×24×0.508 $mm^3$ and the parasitic pixels 808 may be configured in a grid (e.g., a 4×4 grid), be rectangular-shaped, and have an individual pixel size of 6.5×4.5 $mm^2$, although other suitable configurations, shapes, and sizes are also contemplated. Activation of one or more MEMS switches 810 capable of electrically coupling adjacent parasitic pixels 808 may allow the surface geometry of the parasitic layer 804 to be modified, thereby varying the mode of operation of the MRA 800.

In certain embodiments, the electrical properties of the parasitic layer 804 may be determined by the air substrate 900. The parasitic substrate 910 may function to provide support or structure for the parasitic pixels 808. In certain embodiments, the air substrate 900 may be 6 mm thick, which may be beneficial in terms of a trade-off among the performance parameters of bandwidth, gain, and beam-tilt capability. In some embodiments, the air substrate 900 may comprise a foam material (e.g., a polymethacrylimide foam material with $\in_r$=1.043 and tan δ=0.0002 at 5 GHz).

Figure 10:
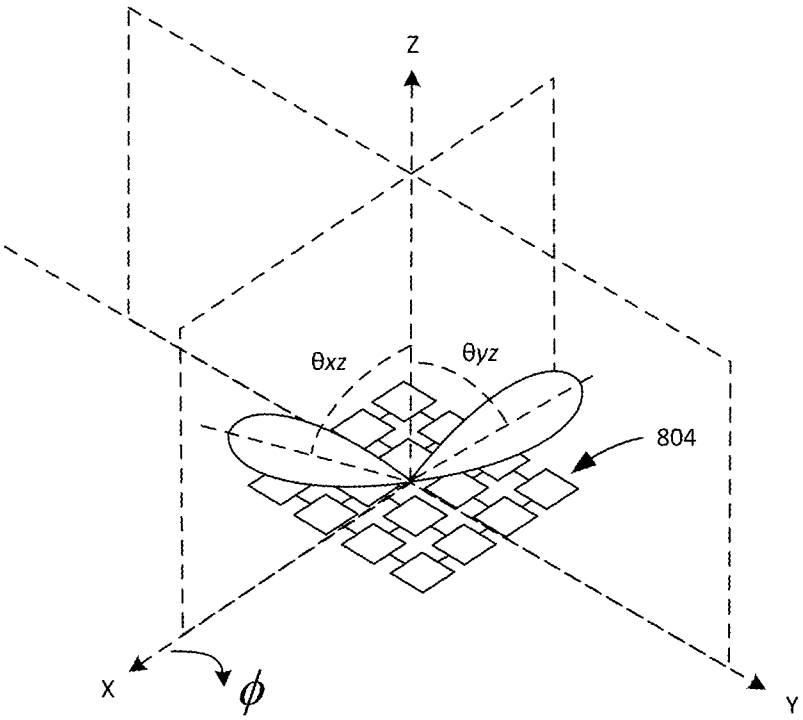
FIG. 10 illustrates exemplary beam steering capabilities of a reconfigurable antenna.

FIG. 10 illustrates exemplary beam-steering capabilities of an individual MRA (e.g., MRA 800) consistent with embodiments disclosed herein. In certain embodiments, the MRAs or the MRAAs disclosed herein may utilize reactively controlled directive arrays to achieve their desired functionality. Accordingly, by the proper reactive loading of the parasitic elements (e.g., pixels 808), the main beam direction of a driven antenna (e.g., MRA 800) may be directed or controlled. Proper reactive loading of an MRA may correspond to a specific geometry of the parasitic pixels 808.

This MRA may not only be capable of steering its main beam, but may also change the polarization state from linear to circular for a given beam direction. In an exemplary MRA having eight modes of operation, the modes of operation may include the three steerable beam directions ($\theta_{xz}$=−30°, 0°, 30°) with linear and circular polarizations in the x-z plane and two steerable beam directions ($\theta_{yz}$=−30°, 30°) in the y-z plane with linear polarization. FIG. 10 illustrates the planes in which the beam may be steered, the beam steering angles (e.g., $\theta_{xz}$ and $\theta_{yz}$), and the placement of the MRA geometry, which may be symmetric along x- and y-axes.

Figure 11:
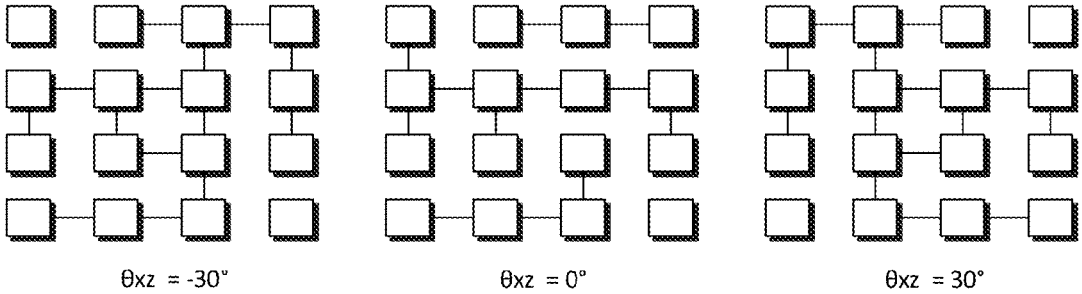
FIG. 11 illustrates geometries of a reconfigurable parasitic pixel surface under eight exemplary operating modes.
Figure 11:
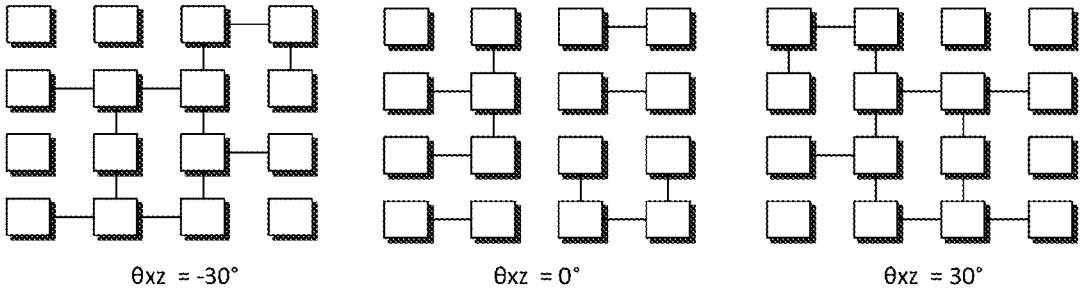
Figure 11:
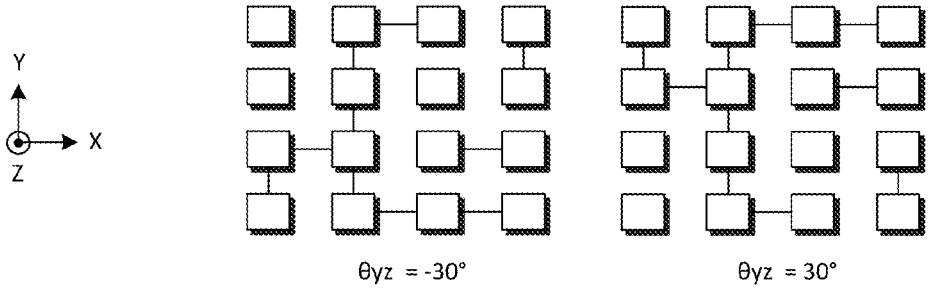

FIG. 11 illustrates geometries of an exemplary reconfigurable parasitic pixel surface under eight exemplary operating modes consistent with embodiments disclosed herein. As discussed above, an MRA consistent with embodiments disclosed herein may be designed in part using multi-objective GA optimization. For example, in certain embodiments, multi-objective GA in conjunction with full-wave EM analysis may be employed to determine the parasitic pixel surface configurations illustrated in FIG. 11 (e.g., to determine the status of the interconnections between adjacent pixels in the parasitic pixel surface). As illustrated, the configurations of the $\theta_{xz}$=−30° and $\theta_{yz}$=−30° operating modes may be symmetric with those of the $\theta_{xz}$=30° and $\theta_{yz}$=30° modes, along y- and x-axes, respectively. In certain embodiments, this may be attributed, at least in part, to a symmetric architecture of the MRA, along x- and y-axes.

Figure 12:
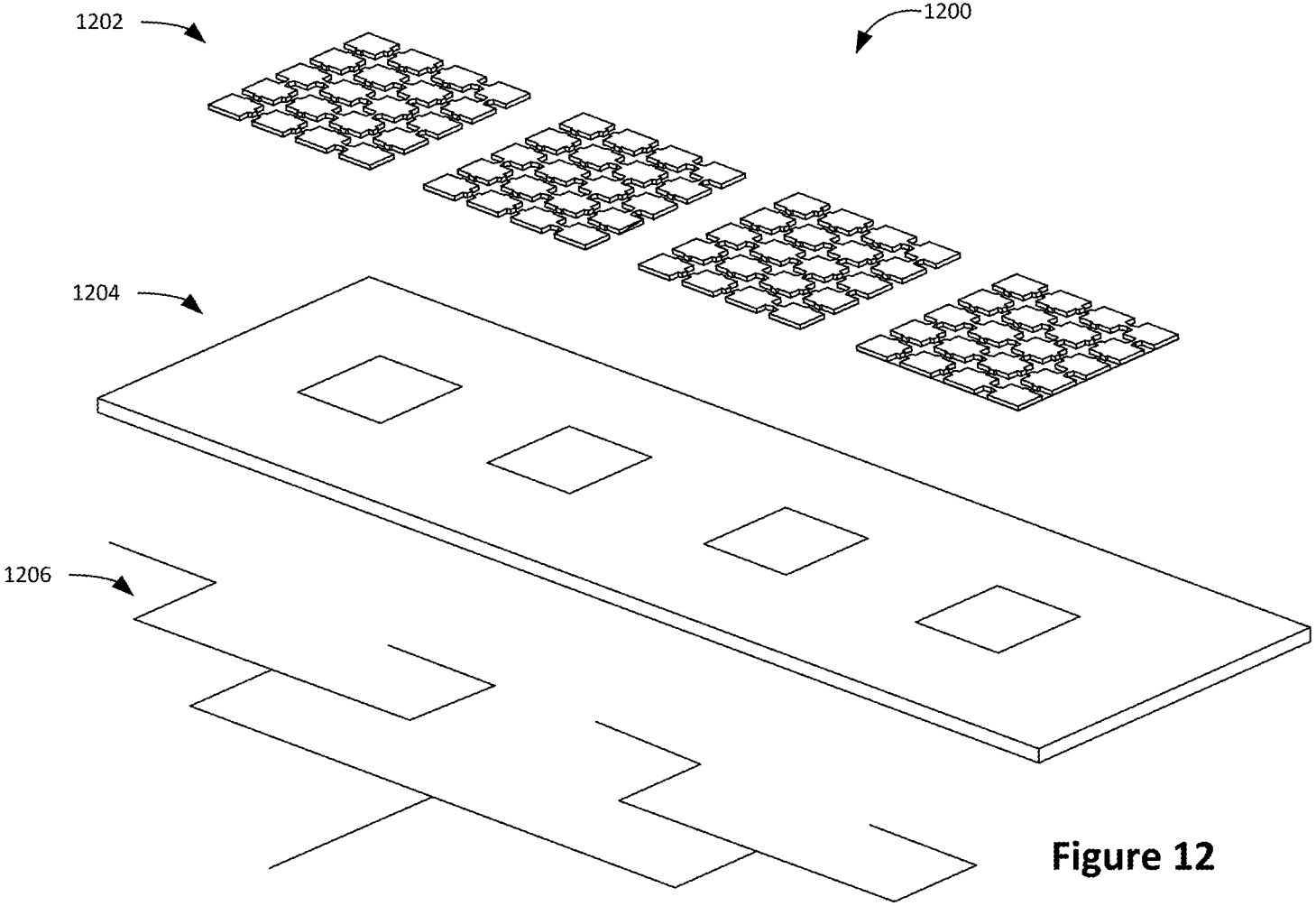
FIG. 12 illustrates an exploded view of a multifunctional reconfigurable antenna array.

FIG. 12 illustrates an exploded view of an MRAA 1200 consistent with embodiments disclosed herein. As illustrated, the MRAA 1200 may include a linear array of MRA elements each comprising a parasitic layer 1202, a patch layer 1204, and a feeding network 1206. Each MRA element of the MRAA 1200 may be designed, at least in part, using a multi-objective GA in conjunction with full-wave analyses. The MRA elements may be configured to operate in at least eight modes of operation within a common operational bandwidth (e.g., with the central frequency of 5.5 GHz). As illustrated, the MRAA 1200 may be formed by a linear combination of four (e.g., 4×1) identical optimized MRA elements arranged along the y-axis.

In certain embodiments, the MRA elements of the MRAA 1200 may be aperture fed by the feeding network 1206 which may be configured as a parallel feed network. In further embodiments, the inter-element spacing between the centers of the adjacent radiators (e.g., patch antennas included on the patch layer 1204) may be 30 mm, which may be approximately half a wavelength of a central operating frequency (e.g., an operating frequency of 5.5 GHz). The structures of the feed network 1206, patch layers 1204, and parasitic layer 1202 may be separately formed on a suitable substrate (e.g., a RO4003C substrate). In certain embodiments, the dimensions of the feed network 1206 and driven patch antennas included in the patch layer 1204 may be 120×66×0.508 $mm^3$ and 120×66×1.524 $mm^3$, respectively. Parasitic pixel arrays included on the parasitic layer 1202 may be 0.508 mm thick and have an alternating width between 32 mm and 2 mm and alternating length between 24 mm and 6 mm. Accordingly, adjacent pixel surfaces may be connected by 2×6 $mm^2$ strips The specific structure of the parasitic layer 1202 may be selected to reduce the mutual coupling between the individual radiators of the MRAA 1200. The three separate structures 1202, 1204, 1206 may then be aligned and assembled together, where air or foam (e.g., 6 mm-thick polymethacrylimide foam) may be used between driven patch antennas and the parasitic layer 1202.

Figure 13:
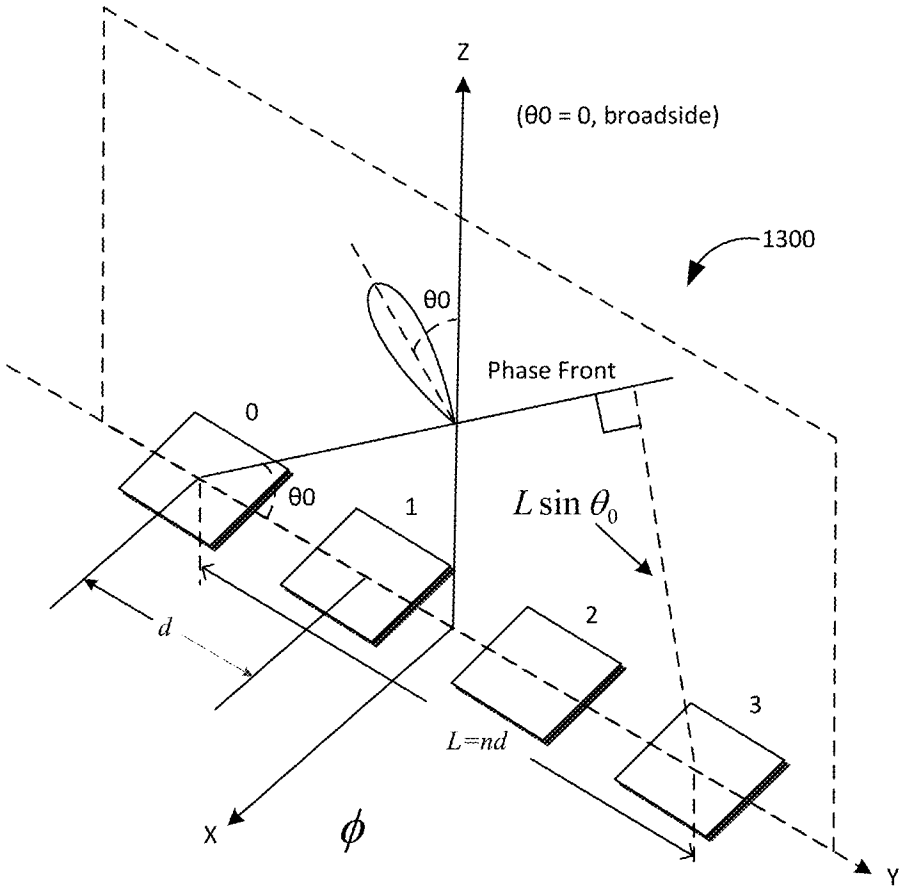
FIG. 13 illustrates a linear antenna array.

FIG. 13 illustrates a fixed linear antenna array 1300 consistent with embodiments disclosed herein. A fixed linear antenna array 1300 may consist of a number of identical or similar antenna elements, where each element may be individually controlled in phase and amplitude. In certain embodiments, the centers of the individual radiators may lie on the y-axis with inter-element spacing being denoted as d. The normalized far-field radiation pattern of the array, F (θ, ϕ), presented below in Equation 13, can be found by using the principle of pattern multiplication:

$$F(\theta,\phi)=E_a(\theta,\phi)F_a(\theta) \tag{13}$$

where $E_a$ (θ,ϕ) is the normalized pattern of the individual radiators also called an element factor, and $F_a$ (θ) is the normalized array factor, which for uniform amplitude excitations may be given by Equation 14:

$$F_a(\theta)=\frac{\sin\left[\frac{N\pi d}{\lambda_0}\right]*(\sin\theta-\sin\theta_0)}{N\sin\left[\frac{\pi d}{\lambda_0}\right]*(\sin\theta-\sin\theta_0)} \tag{14}$$

where N is the total number of array elements, $\theta=\theta_0$ is the beam steering direction in the y-z plane for which the array factor may be at a maximum.

In certain embodiments, the array pattern occurs at a center frequency of $f_0$, when each array element is fed by the complex excitations with uniform amplitude of $a_0$, and progressive phase shift from element to element $k_0 d \sin\theta_0$. In some embodiments, the complex excitations may be expressed according to Equation 15, presented below:

$$a_n=a_0e^{-jk_0nd\sin\theta_0}\ (n=0,1,2,3) \tag{15}$$

where $k_0=2\pi/\lambda_0$ is the free space wave number at the center frequency of $f_0$, and n indicates the element number of each individual radiator of the array with first element having n=0.

Based on Equations 13-15, it may be determined that the radiation pattern of the array may be controlled by the array factor. The element factor $E_a(\theta,\phi)$ for certain fixed linear arrays may be fixed by the initial design of the individual radiators, which means that the radiation properties of the individual radiators cannot be changed, and thus the element factor may not play a significant role in beam-steering function.

A factor related to an antenna array is the concept of pattern "squint". When the operating frequency of an antenna array changes from $f_0$ to $f_1$, the phase front may also change. This, in turn, may result in a shift in the original steering angle from $\theta_0$ to $\theta_1$, thereby causing potential pattern-squint and affecting array bandwidth. Another factor associated with a linear array may be the scan loss. Scan loss may be due to the broadening beam width of the array factor when it is steered away from the broadside direction, and may result in a reduction in the array gain.

Consistent with embodiments disclosed herein, an MRAA may include a plurality of individual radiators (e.g., individual MRAs) of which radiation properties, such as maximum beam directions and sense of polarizations, can be changed. In other words, the element factor is not fixed and has variable properties. This degree of freedom may translate into higher array gain, polarization reconfigurability, and beam-tilt capability not only in y-z plane but also in x-z plane. Also, the scan loss inherit to standard array may be alleviated for the MRAA, when the beam is steered in the x-z plane.

Figure 14:
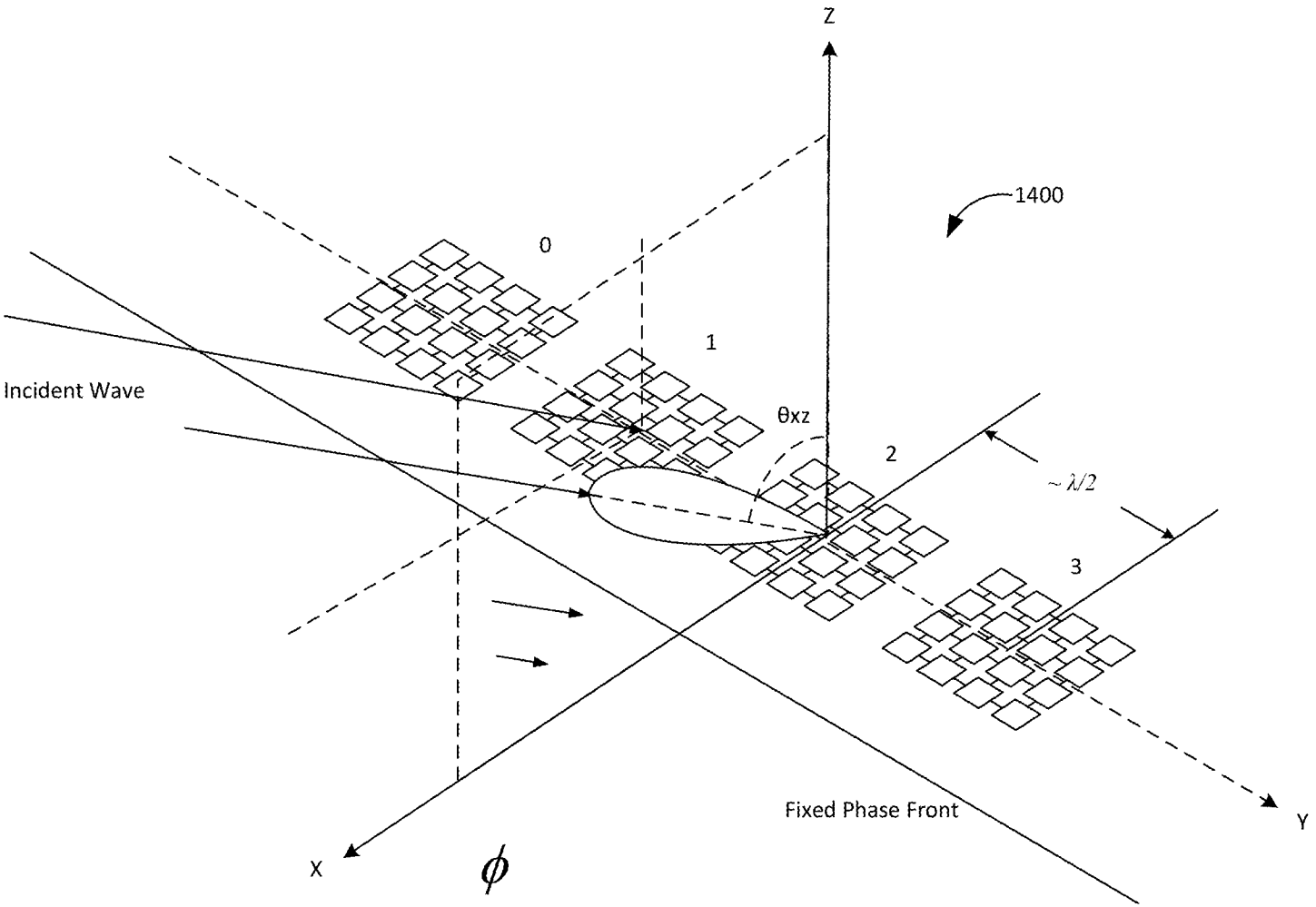
FIG. 14 illustrates beam steering capabilities of a multifunctional reconfigurable antenna array.

FIG. 14 illustrates beam-steering capabilities of an exemplary MRAA 1400 consistent with embodiments disclosed herein. For steering in the x-z plane, the radiation pattern of the MRAA 1400 may not be related to the array factor as it does not take effect in the x-z plane. The beam steering in this plane may be accomplished by the beam-steering capabilities of the individual MRAs of the MRAA 1400. Irrespective of the beam-steering angle, there may be little phase difference from element to element ($\Delta\alpha=k_0 d \sin\theta_0=0$) and accordingly, the phase front may stay parallel to the y-axis along which the array elements are arranged as illustrated.

In certain embodiments, when the modes of operation of the individual MRAs of the MRAA 1400 correspond to the beam-steering modes ($\theta_{xz}=30°$, 0° and −30°), with either linear and circular polarizations, in the x-z plane, the realized gain pattern of the MRAA 1400, $G_T(\theta)$, in this plane may be expressed as the summation of the realized gain patterns of individual MRAs, as presented below in Equation 16:

$$G_T(\theta)=\Sigma_n G_{en}(\theta)\ (n=0\ldots 3)\ (x\text{–}z\text{ plane}) \tag{16}$$

where $G_{en}(\theta)$ represents the imbedded realized gain pattern of the individual $n^{th}$ MRA element in the x-z plane. The term "imbedded" may indicate that an individual gain pattern is obtained when the corresponding MRA is excited, while the other MRAs are terminated with matched loads. In this manner, the effects of mutual coupling among array elements are taken into account when calculating $G_{en}(\theta)$ for each individual radiator of the MRAA 1400.

Under certain conditions, where the effects of mutual coupling are ignored, all elements of the MRAA 1400 may have the same or similar realized gain patterns $G_{en}(\theta)=G_e(\theta)$. Utilizing the principle of superposition given in Equation 15, the realized array gain may be expressed according to Equation 17, presented below:

$$G_T(\theta)=N\times G_{en}(\theta)(x\text{–}z\text{ plane}) \tag{17}$$

In certain embodiments, the working mechanism of the MRAA 1400 steering in the y-z plane may be similar to the working mechanism of a standard linear array. The additional degree of freedom provided by the variable radiation properties of the individual MRA elements of the MRAA 1400 combined with the array factor in the y-z plane may enhance the MRAA 1400 performance as compared to that of a standard array.

Figure 15:
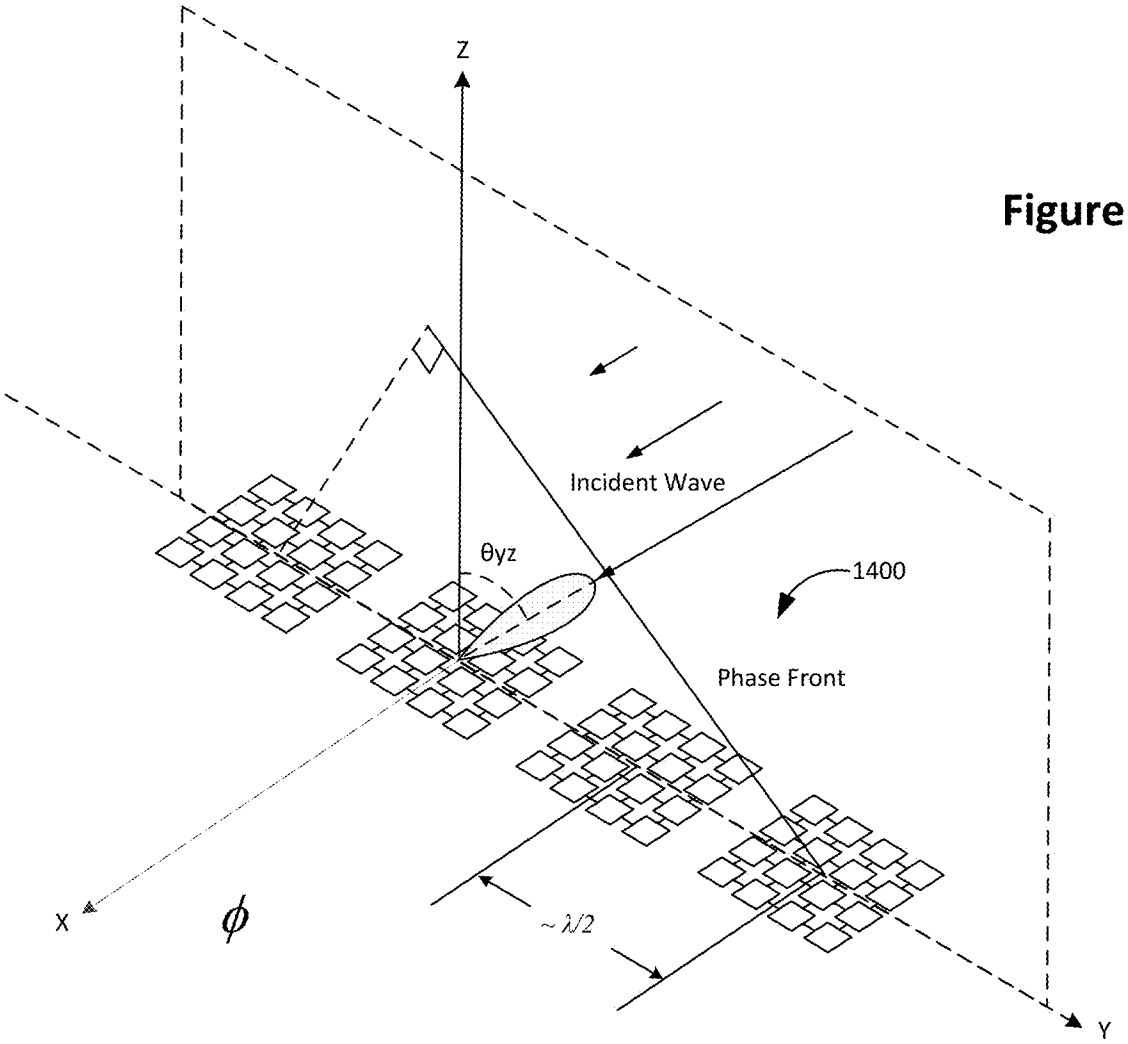
FIG. 15 illustrates further beam-steering capabilities of a multifunctional reconfigurable antenna array.

FIG. 15 illustrates further beam-steering capabilities of a MRAA 1400 array consistent with embodiments disclosed herein. When the MRAA 1400 performs beam steering in the y-z plane, the individual MRA elements may be set to operate in the beam-steering modes in the y-z plane with beam steering angles of $\theta_{yz}=-30°$ and 30. Under these circumstances, the realized gain pattern of the MRAA 1400 can be expressed according to Equation (18), presented below:

$$G_T(\theta)=G_e(\theta)\times N|F_a(\theta)|^2(y\text{–}z\text{ plane}) \tag{18}$$

where $F_a(\theta)$ is the normalized array factor, N is the number of elements, and $G_e(\theta)$ represents the realized gain pattern of an individual MRA in the y-z plane.

The general expression for the realized gain of the MRAA 1400 may be expressed according to Equation 19, presented below:

$$G(\theta,\varphi)=\frac{1\pi R^2}{P_{in}}S(\theta,\varphi) \tag{19}$$

where $S(\theta,\phi)$ is the radiated array power density at the far-field distance of R, and $P_{in}$ represents the input power for the MRAA 1400.

For a given beam direction, the MRAA 1400 can achieve polarization reconfigurability as its individual MRA elements can change the sense of polarization between linear and circular polarizations. Reconfigurability for the beam steering in x-z plane and the y-z plane may be performed by optimizing the pixel surface of the parasitic layer accordingly. Polarization reconfigurability may also be performed. For example, steering in other directions such as θ=±5°, ±10°, ±15°, ±20°, etc., along with polarization reconfigurability both in the x-z and y-z planes may be performed by further optimizing the parasitic pixel surface using the methods disclosed herein.

It will be readily understood that the components of the disclosed embodiments, as generally described herein, could be arranged and designed in a wide variety of different configurations. For example, in certain embodiments, active driven antenna elements may also comprise liquid metal material and may be reconfigurable utilizing microfluidic techniques similar to the those described above. Similarly, in further embodiments, antenna elements (e.g., active or parasitic elements) may comprise an array of microfluidic reservoirs that may be reconfigured to vary the architecture of the antenna. Embodiments disclosed herein may be also incorporated in other suitable antenna architectures and designs. Accordingly, the above detailed description of the embodiments of the systems and methods of the disclosure is not intended to limit the scope of the disclosure, but is merely representative of possible embodiments of the disclosure. In addition, the steps of any disclosed method do not necessarily need to be executed in any specific order, or even sequentially, nor do the steps need be executed only once, unless otherwise specified.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, inventive aspects lie in a combination of fewer than all features of any single foregoing disclosed embodiment. It will be apparent to those having skill in the art that changes may be made to the details of the above-described embodiments without departing from the underlying principles set forth herein.

What is claimed is:

1. A reconfigurable antenna comprising:

an active driven antenna element configured to emit a field of electromagnetic energy; and a parasitic element disposed over the active driven antenna element, the parasitic element being physically separated from the active driven antenna element, the parasitic element comprising an array of selectively reconfigurable pixels and a network of mechanical switches configured to selectively reconfigure the array of selectively reconfigurable pixels based on one or more applied control voltages by physically coupling a plurality of reconfigurable pixels of the array of selectively reconfigurable pixels, the parasitic element being configured to couple with the field of electromagnetic energy emitted by the active driven antenna element via electromagnetic mutual coupling;

wherein the network of mechanical switches are further configured to selectively reconfigure the array of selectively reconfigurable pixels such that a first region of the array of selectively reconfigurable pixels comprising a first subset of reconfigurable pixels is in resonance with the active driven antenna element.

2. The reconfigurable antenna of claim 1, wherein a geometry of the array is reconfigurable.

3. The reconfigurable antenna of claim 1, wherein the mechanical switches comprise microelectromechanical switches.

4. The reconfigurable antenna of claim 1, wherein the reconfigurable antenna is configured to operate at frequencies between 4 GHz and 6 GHz.

5. The reconfigurable antenna of claim 1 further comprising:

highly resistive bias lines configured to drive one or more microelectromechanical switches of the network of microelectromechanical switches by the control voltages.

6. The reconfigurable antenna of claim 1, wherein the array of selectively reconfigurable pixels are arranged in a grid pattern.

7. The reconfigurable antenna of claim 1, wherein the reconfigurable antenna is configured to operate in a plurality of operating modes, each operating mode corresponding to a particular configuration of the array of selectively reconfigurable pixels.

8. The reconfigurable antenna of claim 1, wherein the reconfigurable antenna is configured to operate at a plurality of beam steering angles based at least in part on the configuration of the array of selectively reconfigurable pixels.

9. The reconfigurable antenna of claim 8, wherein the plurality of beam steering angles include at least one of beam steering angle between $\theta_i$=−60° and 60°.

10. The reconfigurable antenna of claim 1, wherein the reconfigurable antenna is configured to operate at a Linear, Circular, or Elliptical polarization based at least in part on the configuration of the array of selectively reconfigurable pixels.

11. The reconfigurable antenna of claim 1, wherein the reconfigurable antenna includes a plurality of antenna array elements, each antenna array element including at least one of the active driven antenna element and the parasitic element.

12. A reconfigurable antenna comprising a plurality of antenna array elements, each antenna array element comprising:

an active driven antenna element configured to emit an electromagnetic field; and a parasitic element disposed over the active driven antenna element, the parasitic element comprising an array of selectively reconfigurable pixels configured to couple with the electromagnetic field emitted by the active driven antenna element via electromagnetic mutual coupling and a network of mechanical switches configured to selectively reconfigure the array of selectively reconfigurable pixels based on one or more applied control voltages by physically coupling a plurality of reconfigurable pixels of the array of selectively reconfigurable pixels, wherein the network of mechanical switches are further configured to selectively reconfigure the array of selectively reconfigurable pixels such that a first region of the array of selectively reconfigurable pixels comprising a first subset of reconfigurable pixels is in resonance with the active driven antenna element.

13. The reconfigurable antenna of claim 12, wherein the antenna array elements are arranged in a linear array configuration.

14. The reconfigurable antenna of claim 12, wherein the reconfigurable antenna is configured to operate at frequencies between 4 GHz and 6 GHz.

15. The reconfigurable antenna of claim 12 further comprising:

an aperture coupled feed line configured to feed the active driven antenna element.

16. The reconfigurable antenna of claim 12, wherein the array of selectively reconfigurable pixels are arranged in a grid pattern.

17. The reconfigurable antenna of claim 12, wherein a foam substrate is configured to separate the parasitic element from the active driven antenna element.

18. The reconfigurable antenna of claim 12, wherein the reconfigurable antenna is configured to operate at a plurality of beam steering angles based at least in part on the configuration of the array of selectively reconfigurable pixels.

19. The reconfigurable antenna of claim 18, wherein the plurality of beam steering angles include at least one of beam steering angle between $\theta_i$=−60° and 60°.

20. The reconfigurable antenna of claim 12, wherein the reconfigurable antenna is configured to operate at a Linear, Circular, or Elliptical polarization based at least in part on the configuration of the parasitic element.

21. The reconfigurable antenna of claim 1, wherein the network of mechanical switches are further configured to selectively reconfigure the array of selectively reconfigurable pixels such that a second region of the array of selectively reconfigurable pixels comprising a second subset of reconfigurable pixels is not in resonance with the active driven antenna element.

22. The reconfigurable antenna of claim 12, wherein the network of mechanical switches are further configured to selectively reconfigure the array of selectively reconfigurable pixels such that a second region of the array of selectively reconfigurable pixels comprising a second subset of reconfigurable pixels is not in resonance with the active driven antenna element.

* * * * *